US005531839A

United States Patent [19]

Hosoya et al.

[11] Patent Number: 5,531,839

[45] Date of Patent: Jul. 2, 1996

[54] CONTINOUSLY ANNEALED COLD-ROLLED STEEL SHEET EXCELLENT IN BALANCE BETWEEN DEEP DRAWABILITY AND RESISTANCE TO SECONDARY-WORK EMBRITTLEMENT AND METHOD FOR MANUFACTURING SAME

[75] Inventors: Yoshihiro Hosoya; Masaya Morita; Seishi Tsuyama, all of Tokyo, Japan

[73] Assignee: NKK Corporation, Tokyo, Japan

[21] Appl. No.: 407,011

[22] PCT Filed: Oct. 5, 1994

[86] PCT No.: PCT/JP94/01663

§ 371 Date: Mar. 28, 1995

§ 102(e) Date: Mar. 28, 1995

[87] PCT Pub. No.: WO95/09931

PCT Pub. Date: Apr. 13, 1995

[30] Foreign Application Priority Data

Oct. 5, 1993 [JP] Japan ..... 5-273126
Oct. 13, 1993 [JP] Japan ..... 5-280224

[51] Int. Cl.[6] ..... C21D 8/04; C22C 38/14
[52] U.S. Cl. ..... 148/330; 148/603
[58] Field of Search ..... 148/603, 330

[56] References Cited

FOREIGN PATENT DOCUMENTS 59-140333 8/1984 Japan .
61-32375 7/1986 Japan .
61-276927 12/1986 Japan .
62-278232 12/1987 Japan .
63-317625 12/1988 Japan .
1-294823 1/1989 Japan .
1-184227 7/1989 Japan .
A-3-94022 4/1991 Japan .
A-3-94021 4/1991 Japan .

*Primary Examiner*—Deborah Yee
*Attorney, Agent, or Firm*—Frishauf, Holtz, Goodman, Langer & Chick

[57] ABSTRACT

A continuously annealed cold-rolled steel sheet excellent in balance between deep drawability and resistance to secondary-work embrittlement, which consists essentially of: under 0.0030 wt. % carbon, up to 0.05 wt. % silicon, from 0.05 to 0.20 wt. % manganese, up to 0.02 wt. % phosphorus, up to 0.15 wt. % sulfur, from 0.025 to 0.06 wt. % soluble aluminum, up to 0.0030 wt. % nitrogen, from 0.02 to 0.10 wt. % titanium, from 0.0003 to 0.0010 wt. % boron, and the balance being iron and incidental impurities, where a value of an index (X) representing a content rate of titanium to boron, as calculated by specific formulae, is of from 9.2 to 11.2. The above-mentioned continuously annealed cold-rolled steel sheet is manufactured by: carrying out a finishing-rolling in a hot-rolling of a steel slab having the above-mentioned chemical composition so that a reduction rate distribution function (Y) as expressed by another specific formula is satisfied; completing the finishing-rolling at a temperature of from 880° to 920° C.; then coiling the resultant hot-rolled steel strip; then cold-rolling the hot-rolled steel strip at an accumulative reduction rate of at least 70%; and then continuously annealing the resultant cold-rolled steel strip in a temperature region of from 750° C. to an $Ac_3$ transformation point.

6 Claims, 6 Drawing Sheets

CONTINOUSLY ANNEALED COLD-ROLLED STEEL SHEET EXCELLENT IN BALANCE BETWEEN DEEP DRAWABILITY AND RESISTANCE TO SECONDARY-WORK EMBRITTLEMENT AND METHOD FOR MANUFACTURING SAME

FIELD OF THE INVENTION

The present invention relates to a continuously annealed cold-rolled steel sheet excellent in balance between deep drawability and resistance to secondary-work embrittlement, using ultra-low-carbon steel as a material, and a method for manufacturing same. The continuously annealed cold-rolled steel sheet of the present invention is suitable for the application of a surface treatment such as a dip-plating. A continuous annealing line for manufacturing the continuously annealed cold-rolled steal sheet of the present invention may include a dip-plating treatment equipment and an alloying treatment equipment of a dip-plating layer.

BACKGROUND OF THE INVENTION

The recent progress of a degassing technology in the steel making industry has made it possible to manufacture ultra-low-carbon steel in which a carbon (C) content is reduced to up to 30 ppm at a relatively low cost in a large quantity. Steel known as IF steel (abbreviation of interstitial atoms free steel) comprising the above-mentioned ultra-low-carbon steel added with at least one of niobium (Nb), titanium (Ti), boron (B) and zirconium (Zr), is popularly used as a preferred material for manufacturing, through a continuous annealing treatment, a cold-rolled steel sheet for ultra-deep drawing of the EDDQ (abbreviation of excellent deep drawing quality)-class required to have deep drawability and non-aging property.

IF steel commonly used as a material for a continuously annealed cold-rolled steel sheet is ultra-low-carbon steel added with any one or both of titanium and niobium. Titanium is a strong element forming carbide and nitride in steel, and furthermore, titanium has a function of fixing sulfur in steel by forming sulfide through combination with sulfur in steel. IF steel added with titanium (hereinafter referred to as "Ti-IF steel") therefore provides an advantage of permitting stable availability of very excellent deep drawability and ductility within a wide range of a chemical composition of steel.

However, since titanium is an element easily oxidized, titanium oxide produced in molten Ti-IF steel during the continuous casting thereof, adheres and accumulates onto the surface of a bore of a pouring nozzle of a tundish, thus causing reduction or clogging of the bore, or surface defects of a slab are caused by titanium oxide. Addition of titanium in an amount sufficient to completely fix carbon in steel in the form of titanium carbide (TiC) to steel, causes a degradation in grain boundary strength of the annealed cold-rolled steel sheet, and upon subjecting the annealed cold-rolled steel sheet to the deep drawing, a problem of secondary-work embrittlement is caused in the annealed cold-rolled steel sheet. For the solution of secondary-work embrittlement, addition of boron in a slight amount to steel is known to be effective. Addition of boron to steel however results in deterioration of deep drawability of the cold-rolled steel sheet.

There is known another IF steel added with niobium (hereinafter referred to as "Nb-IF steel") as steel solving the above-mentioned problems. In Nb-IF steel, in which carbon in steel is fixed in steel in the form of niobium carbide (NbC), a cold-rolled steel sheet excellent in deep drawability is available, as in Ti-IF steel. A problem in Nb-IF steel is however that a range of an appropriate niobium content is tight. Since surface defects of a slab are hardly caused by oxide inclusions in Nb-IF steel, on the other hand, it is not necessary to scarf the surface of a continuously cast Nb-IF steel slab. This provides an advantage that it is possible to manufacture a hot-rolled steel strip from a high-temperature continuously cast slab of Nb-IF steel by the application of a method known as the hot-direct rolling method comprising directly hot-rolling a slab without reheating same. When using IF steel as a material for an alloying-treated zinc dip-plated cold-rolled steel sheet, it is known that adhesiveness of an alloying-treated zinc dip-plating layer to a cold-rolled steel sheet is improved more in Nb-IF steel or in IF steel added with both niobium and titanium (hereinafter referred to as "Nb-Ti-IF steel") than in Ti-IF steel.

With a view to further improving properties of the above-mentioned Ti-IF steel or Nb-IF steel, various methods have been proposed as described below.

(1) As a method for manufacturing a cold-rolled steel sheet having desired properties, which uses Nb-Ti-IF steel as a material, Japanese Patent Publication No. 61-32,375 published on Jul. 26, 1986 discloses a method for manufacturing an ultra-deep drawing cold-rolled steel sheet, which comprises the steps of:

hot-rolling a steel slab consisting essentially of:

carbon (C): up to 0.007 wt. %, silicon (Si): up to 0.8 wt. %, manganese (Mn): up to 1.0 wt. %, phosphorus (P): up to 0.1 wt. %, aluminum (Al): from 0.01 to 0.1 wt. %, nitrogen (N): up to 80 ppm, titanium (Ti): from 0.010 to 0.037 wt. %, niobium (Nb): from 0.003 to under 0.025 wt. %, where, (1) $48/14[N(\%)-0.002(\%)]<Ti(\%)$, and (2) $Ti(\%)<[4.00\ C(\%)+3.43N(\%)]$, and the balance being iron (Fe) and incidental impurities; then cold-rolling the resultant hot-rolled steel sheet; and then continuously annealing the resultant cold-rolled steel sheet within a temperature region of from 700° C. to $Ac_3$ transformation point (hereinafter referred to as the "prior art 1").

The fundamental technical idea of the prior art 1 is to completely fix nitrogen and carbon in steel within steel, before the hot-finishing-rolling of a steel sheet, by converting nitrogen in steel into titanium nitride (TiN) and converting carbon in steel into niobium-titanium carbides ([Nb-Ti]C).

(2) As described above, addition of boron in a slight amount to IF steel is very effective in inhibiting secondary-work embrittlement of a cold-rolled steel sheet, while causing deterioration of deep drawability of the cold-rolled steel sheet. Therefore, addition of boron to IF steel has not conventionally been considered the best practice. As a method for manufacturing a cold-rolled steel sheet having desired properties, which uses Nb-Ti-IF steel positively added with boron, as a material, Japanese Patent Provisional Publication No. 63-317,625 published on Dec. 26, 1988 discloses a method for manufacturing an ultra-low-carbon cold-rolled steel sheet excellent in fatigue resistance at a spot-welding zone, which comprises the steps of:

hot-rolling a steel slab consisting essentially of:

carbon (C): up to 0.004 wt. %, silicon (Si): up to 0.1 wt. %, manganese (Mn): up to 0.5 wt. %, phosphorus (P) : up to 0.025 wt. %, sulfur (S): up to 0.025 wt. %, nitrogen (N): up to 0.004 wt. %, aluminum (Al): from 0.01 to 0.10 wt. %, titanium (Ti): from 0.01 to 0.04 wt. %, niobium (Nb): from 0.001 to 0.010 wt. %, boron (B): from 0.0001 to 0.010 wt. %, where (1) $(11/93)Nb-0.0004 \leqq B \leqq (11/93)Nb+0.004$, (2) $Ti>(48/12)C+(48/14)N$, (3) $Nb<1/5\cdot(93/48)Ti$, and (4) $C+(12/14)N+(12/11)B>0.0038$, and the balance being iron (Fe) and incidental impurities, at a finishing temperature within a range of from 700° to 900° C. and a coiling temperature within a range of from 300° to 600° C.; then cold-rolling the resultant hot-rolled steel sheet at a reduction rate within a range of from 60 to 85%; then continuously annealing the resultant cold-rolled steel sheet at a temperature within a range of from a recrystallization temperature to 780° C.; and then temper-rolling same at a reduction rate within a range of from [thickness (mm)+0.1] to 3.0% (hereinafter referred to as the "prior art 2").

The fundamental technical idea of the prior art 2 is to ensure a sufficient strength of a welding heat-affected zone and a satisfactory deep drawability of a cold-rolled steel sheet by refining the structure of the welding heat-affected zone through addition of boron together with titanium and niobium to steel to prevent deterioration of strength of the welding heat-affected zone, which is an inevitable defect of IF steel.

(3) As a method for manufacturing a cold-rolled steel sheet excellent not only in resistance to secondary-work embrittlement, but also in surface treatability such as uniformity and glossiness of a plating layer, which uses Nb-Ti-IF steel added with boron, as a material, Japanese Patent Provisional Publication No. 59-140,333 published on Aug. 11, 1984 discloses a method for manufacturing a cold-rolled steel sheet for deep drawing excellent in resistance to secondary-work embrittlement and surface treatability, which comprises the steps of:

hot-rolling a steel slab consisting essentially of:

carbon (C): from 0.0010 to 0.010 wt. %, silicon (Si): up to 0.5 wt. %, manganese (Mn): up to 1.4 wt. %, phosphorus (P): up to 0.05 wt. %, sulfur (S): up to 0.020 wt. %, acid-soluble aluminum (sol.Al): from 0.005 to 0.10 wt. %, nitrogen (N): up to 0.0040 wt. %, titanium (Ti): up to 0.08 wt. %, where, $Ti/(C+N) \geqq 3.0$, boron (B): up to 0.0006 wt. %, and the balance being iron (Fe) and incidental impurities, at a starting temperature of at least 950° C.; then cold-rolling the resultant hot-rolled steel sheet; and then recrystallization-annealing the resultant cold-rolled steel sheet (hereinafter referred to as the "prior art 3").

The fundamental technical idea of the prior art 3 is to add boron to improve resistance to secondary-work embrittlement, and limiting the amount of added boron to a slight amount to improve surface treatability.

(4) As a method for manufacturing an alloying-treated zinc dip-plated cold-rolled steel sheet having an improved resistance to secondary-work embrittlement and a deep drawability kept constant, which uses Ti-IF steel added with boron, as a material, Japanese Patent Provisional Publication No. 1-184,227 published on Jul. 21, 1989 discloses a method for manufacturing an alloying-treated zinc dip-plated cold-rolled steel sheet excellent in deep drawability, which comprises the steps of:

hot-rolling a steel slab consisting essentially of:

carbon (C): up to 0.003 wt. %, silicon (Si): up to 0.1 wt. %, manganese (Mn): from 0.05 to 1.0 wt. %, phosphorus (P): from 0.005 to 0.1 wt. %, sulfur (S): up to 0.02 wt. %, aluminum (Al): from 0.02 to 0.1 wt. %, nitrogen (N): up to 0.0030 wt. %, titanium (Ti): from 0.03 to 0.1 wt. %, boron (B): from 0.0003 to 0.0010 wt. %, and the balance being iron (Fe) and incidental impurities, at a final reduction rate of up to 20% in a finishing-rolling; then cold-rolling the resultant hot-rolled steel sheet; then subjecting the resultant cold-rolled steel sheet to a continuous zinc dip-plating treatment; and then subjecting the thus formed zinc dip-plating layer to an alloying treatment (hereinafter referred to as the "prior art 4").

The fundamental technical idea of the prior art 4 is to improve deep drawability of an alloying-treated zinc dip-plated cold-rolled steel sheet by specifying a hot-rolling condition of a cold-rolled steel sheet.

(5) In a method for manufacturing a cold-rolled steel sheet including the hot-direct rolling method comprising directly hot-rolling a high-temperature continuously cast slab without reheating same, it has been difficult to manufacture a cold-rolled steel sheet for deep drawing having an excellent non-aging property on a similar level to that available in a method for manufacturing a cold-rolled steel sheet including the usual hot-rolling method comprising once cooling a high-temperature continuously cast slab, then reheating same, and then hot-rolling same. As a method for manufacturing a cold-rolled steel sheet excellent in non-aging property and deep drawability, based on the hot-direct rolling method, which solves this problem, Japanese Patent Provisional Publication No. 62-278,232 published on Dec. 3, 1987 discloses a method for manufacturing a cold-rolled steel sheet for deep drawing excellent in non-aging property, based on the hot-direct rolling method, which comprises the steps of:

directly hot-rolling a high-temperature continuously cast steel slab consisting essentially of:

carbon (C): up to 0.004 wt. %, silicon (Si): up to 0.1 wt. %, manganese (Mn): from 0.05 to 0.3 wt. %, phosphorus (P): up to 0.05 wt. %, sulfur (S): up to 0.03 wt. %, soluble aluminum (sol.Al): from 0.01 to 0.08 wt. %, nitrogen (N): up to 0.004 wt. %, niobium (Nb): from 0.005 to 0.03 wt. %, titanium (Ti): from 0.005 to 0.03 wt. %, boron (B): up to 0.003 wt. %, and the balance being iron (Fe) and incidental impurities, without preheating same, with the use of a hot-rolling mill which comprises a roughing-rolling train and a finishing-rolling train;

limiting, when carrying out said hot-rolling, a reduction rate at two roll stands on the exit side of said roughing-rolling train to at least 45%, respectively, limiting an accumulative reduction rate at said two roll stands on the exit side of said roughing-rolling train to at least 70%, limiting an accumulative reduction rate at two roll stands on the entry side of said finishing-rolling train to at least 70%, limiting an accumulative reduction rate at two roll stands on the exit side of said finishing-rolling train to up to 20%, and completing said hot-rolling at a finishing temperature of at least 880° C.;

coiling the resultant hot-rolled steel strip at a temperature within a range of from 640° to 800° C.;

cold-rolling said hot-rolled steel strip at a reduction rate within a range of from 70 to 90%; and continuously annealing the resultant cold-rolled steel strip within a temperature region of from a recrystallization temperature to an $Ac_3$ transformation point (hereinafter referred to as the "prior art 5").

The fundamental technical idea of the prior art 5 is to limit accumulative reduction rates in the roughing-rolling train and the finishing-rolling train of the hot-rolling mill, based on the hot-direct rolling method, thereby improving non-aging property and deep drawability of a cold-rolled steel sheet.

(6) It is known that a cold-rolled steel sheet for ultra-deep drawing is available by cold-rolling a hot-rolled steel sheet at a high reduction rate of from about 75% to about 90%. It is however practically difficult to adopt such a high cold-rolling reduction rate because of the construction and the capacity of a cold-rolling mill. As a method for manufacturing a cold-rolled steel sheet for ultra-deep drawing, which solves the above-mentioned problems, Japanese Patent Provisional Publication No. 1-294,823 published on Nov. 28, 1989 discloses a method for manufacturing a cold-rolled steel sheet excellent in ultra-deep drawability, which comprises the steps of:

hot-roughing-rolling a steel slab consisting essentially of:

carbon (C): up to 0.01 wt. %, nitrogen (N): up to 0.01 wt. %, titanium (Ti): up to 0.2 wt. %, niobium (Nb): up to 0.2 wt. %, where, $(C/12+N/14)<(Ti/48+Nb/93)$ and the balance being iron (Fe) and incidental impurities, at a temperature within a range of from 900° to 1,200° C., to precipitate carbide and nitride of titanium and/or niobium, thereby reducing the total content of solid-solution carbon and solid-solution nitrogen to up to 20 ppm;

hot-finishing-rolling the thus roughing-rolled steel slab at a temperature within a range of from 880° to 660° C., with the use of rolling rolls of which the ratio of a roll diameter ($D_1$) to a finished thickness ($t_1$) satisfies the following formula:

$$D_1>100t_1$$

at a reduction rate ($R_1$) within a non-recrystallization temperature region;

coiling the resultant hot-rolled steel strip at a temperature of up to 600° C.;

cold-rolling said hot-rolled steel strip, with the use of rolling rolls of which the ratio of a roll diameter ($D_2$) to a finished thickness ($t_2$) satisfies the following formula:

$$D_2>100t_2$$

at a reduction rate ($R_2$) satisfying the following formula:

$$R_2>50\%$$

where, $95\%>(R_1+R_2)>75\%$; and annealing the resultant cold-rolled steel strip (hereinafter referred to as the "prior art 6").

The fundamental technical idea of the prior art 6 is to improve a crystal texture of a cold-rolled steel sheet by limiting the ratio of the roll diameter of the rolling rolls to the finished thickness of the steel sheet in the hot-rolling and the cold-rolling, thereby improving deep drawability of the cold-rolled steel sheet.

(7) As a method for manufacturing a cold-rolled steel sheet excellent in deep drawability, in which a further higher synergistic effect brought about by the coexistence of niobium and titanium in Nb-Ti-IF steel is remarkably exhibited, Japanese Patent Provisional Publication No. 61-276,927 published on Dec. 6, 1986 discloses a method for manufacturing a cold-rolled steel sheet excellent in deep drawability, which comprises the steps of:

hot-finishing-rolling a steel slab consisting essentially of:

carbon (C): up to 0.0050 wt. %, silicon (Si): up to 1.0 wt. %, manganese (Mn): up to 1.0 wt. %, titanium (Ti): from [48/14N(%)+48/32S(%)] to [3×48/12C(%)+48/14N(%)+48/32S(%)] wt. %, niobium (Nb): from [0.2×93/12C(%)] to [93/12C(%)] wt. %, aluminum (Al): from 0.005 to 0.10 wt. %, phosphorus (P): up to 0.15 wt. %, nitrogen (N): up to 0.0050 wt. %, sulfur (S): up to 0.015 wt. %, and the balance being iron (Fe) and incidental impurities;

starting a cooling of the resultant hot-rolled steel strip within two seconds from the completion of said hot-finishing-rolling of said steel slab, cooling said hot-rolled steel strip at an average cooling rate of at least 10° C./second before a start of coiling of said hot-rolled steel strip, and coiling said steel strip at a temperature of up to 710° C.;

cold-rolling said hot-rolled steel strip at a reduction rate of at least 50%;

subjecting the resultant cold-rolled steel strip to a continuous annealing treatment which comprises heating said cold-rolled steel strip at a heating rate of at least 5° C./second to a temperature region of from 400° to 600° C., and then, soaking same at a temperature within a range of from 700° C. to an $Ac_3$ transformation point for more than a second (hereinafter referred to as the "prior art 7").

The fundamental technical idea of the prior art 7 is to improve deep drawability of a cold-rolled steel sheet by limiting the timing of the start and the end of cooling of a hot-rolled steel strip during a period from the completion of hot-finishing-rolling to the start of coiling.

Along with the recent tendency toward more and more complicated and larger automobile parts and placing importance on rust preventiveness thereof, there is increasing the scope of application of a cold-rolled steel sheet for ultra-deep drawing of the EDDQ-class, which has so far been used only for portions requiring a severe press-forming (for example, a rear quarter portion), and EDDQ-class cold-rolled steel sheets are now being used in large quantities.

For the purpose of improving productivity of cold-rolled steel sheets, on the other hand, a continuous annealing of a cold-rolled steel sheet has become more popular. The continuous annealing, being carried out at a relatively high cooling rate, is suitable for annealing an ultra-low-carbon cold-rolled steel sheet. Under such circumstances, cold-rolled steel sheets made of IF steel which is ultra-low-carbon steel, have now been manufactured in large quantities through the continuous annealing. As described above, however, Ti-IF steel has an inevitable problem of secondary-work embrittlement. A careful consideration should therefore be taken when determining a chemical composition of Ti-IF steel.

In the prior arts 1 and 2, however, it is necessary to limit the niobium content in steel within a very tight appropriate range. In the prior arts 3 and 4, no regard is given to the improvement of balance between deep drawability and resistance to secondary-work embrittlement. In the prior arts 5 to 7, the appropriate relationship between the boron content in steel and the distribution of reduction rates during the hot-finishing-rolling, is not considered at all. When mass-producing cold-rolled steel sheets made of IF steel as a general-purpose breed, therefore, the problems intrinsic to IF steel such as secondary-work embrittlement may become more apparent. Sufficient care should therefore be taken upon determining a chemical composition of the cold-rolled steel sheet.

An object of the present invention is therefore to provide a chemical composition of a cold-rolled steel sheet, which is the most suitable for achieving a good balance between deep drawability and resistance to secondary-work embrittlement, which are two contradictory properties of a cold-rolled steel sheet made of IF steel, by solving the above-mentioned problems, and further to provide a method for manufacturing a continuously annealed cold-rolled steel sheet excellent in balance between deep drawability and resistance to secondary-work embrittlement, having the most desirable chemical composition as described above.

DISCLOSURE OF THE INVENTION

In accordance with one of the features of the present invention, there is provided a continuously annealed cold-rolled steel sheet excellent in balance between deep drawability and resistance to secondary-work embrittlement, which consists essentially of:

carbon (C): under 0.0030 wt. %, more preferably, from 0.0010 to 0.0015 wt. %, silicon (Si): up to 0.05 wt. %, manganese (Mn): from 0.05 to 0.20 wt. %, phosphorus (P): up to 0.02 wt. %, sulfur (S): up to 0.015 wt. %, more preferably, up to 0.010 wt. %, acid-soluble aluminum (sol.Al): from 0.025 to 0.06 wt. %, nitrogen (N): up to 0.0030 wt. %, titanium (Ti): from 0.02 to 0.10 wt. %, more preferably, from 0.02 to under 0.07 wt. %, boron (B): from 0.0003 to 0.0010 wt. %, and the balance being iron (Fe) and incidental impurities, where, a value of index (X) representing a content rate of titanium to boron, as calculated by the following formulae (1) and (2), is within a range of from 9.2 to 11.2:

$$X=-\ln\{(C/Ti^*)B\} \quad (1)$$

in said formula (1):

$$Ti^*=Ti-(48/14)N-(48/32)S>0 \quad (2).$$

In accordance with another feature of the present invention, there is provided a method for manufacturing a continuously annealed cold-rolled steel sheet excellent in balance between deep drawability and resistance to secondary-work embrittlement, which comprises the steps of:

preparing a steel slab consisting essentially of:

carbon (C): under 0.0030 wt. %, more preferably, from 0.0010 wt. % to 0.0015 wt. %, silicon (Si): up to 0.05 wt. %, manganese (Mn): from 0.05 to 0.20 wt. %, phosphorus (P): up to 0.02 wt. %, sulfur (S): up to 0.015 wt. %, more preferably, up to 0.010 wt. %, acid-soluble aluminum (sol.Al): from 0.025 to 0.06 wt. %, nitrogen (N): up to 0.0030 wt. %, titanium (Ti): from 0.02 to 0.10 wt. %, more preferably, from 0.02 to under 0.07 wt. %, boron (B): from 0.0003 to 0.0010 wt. %, and the balance being iron (Fe) and incidental impurities, where, a value of index (X) representing a content ratio of titanium to boron, as calculated by the following formulae (1) and (2), is within a range of from 9.2 to 11.2:

$$X=-\ln\{(C/Ti^*)B\} \quad (1)$$

in said formula (1):

$$Ti^*=Ti-(48/14)N-(48/32)S>0 \quad (2);$$

then, hot-rolling said steel slab to prepare a hot-rolled steel strip;

carrying out a finishing-rolling in said hot-rolling so that a reduction rate distribution function (Y) expressed by the following formula (3) satisfies the following formula (4):

$$Y=\{ln(t_{n-3}/t_{n-2})+ln(t_{n-2}/t_{n-1})\}/ln(t_0/t_n) \quad (3)$$

where, n: number of roll stands of a finishing-rolling train in a hot-rolling mill, $t_0$: thickness of a steel sheet on the entry side of the first roll stand of said finishing-rolling train, $t_{n-3}$: thickness of the steel sheet on the exit side of the n-3-th roll stand of said finishing-rolling train, $t_{n-2}$: thickness of the steel sheet on the exit side of the n-2-th roll stand of said finishing-rolling train, $t_{n-1}$: thickness of the steel sheet on the exit side of the n-1-th roll stand of said finishing-rolling train, and $t_n$: thickness of the steel sheet on the exit side of the n-th roll stand of said finishing-rolling train, and $$0.015X+0.09 \leqq Y \leqq 0.01X+0.21 \quad (4)$$

where,

X: said index calculated by said formulae (1) and (2); then completing said finishing-rolling at a temperature within a range of from 880° to 920° C.; then coiling the resultant hot-rolled steel strip; then subjecting said hot-rolled steel strip to a cold-rolling at an accumulative reduction rate of at least 70% to prepare a cold-rolled steel strip; and then subjecting said cold-rolled steel strip to a continuous annealing in a temperature region of from 750° C. to an $Ac_3$ transformation point.

DETAILED DESCRIPTION OF THE PREFERRED EMBODIMENTS

Figure 1:
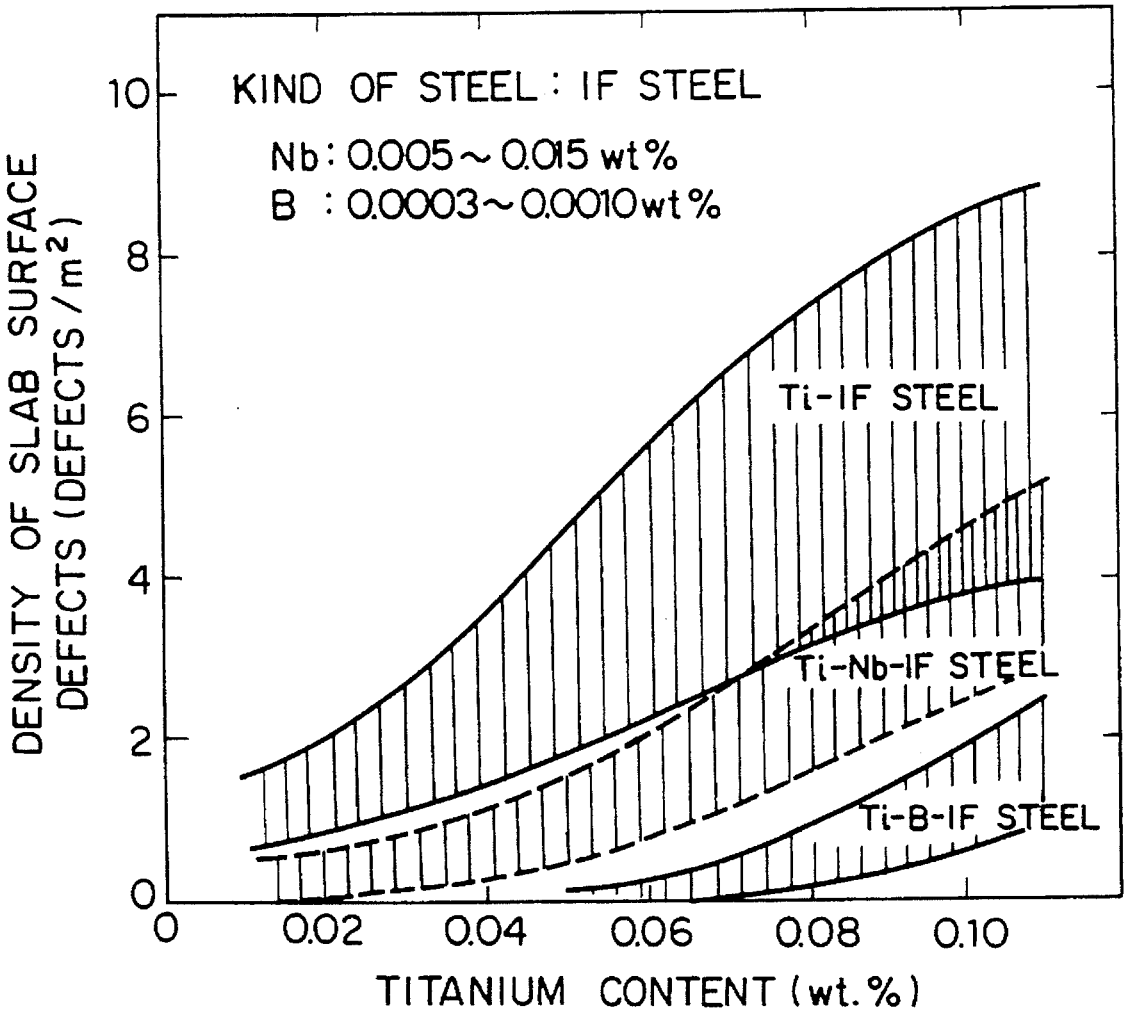
FIG. 1 is a graph illustrating the effect of a titanium content on a density of produced surface defects (i.e., pinholes) in a continuously cast steel slab prepared from each of Ti-IF steel, Ti-Nb-IF steel and Ti-B-IF steel.

From the above-mentioned point of view, extensive studies were carried out to develop a continuously annealed cold-rolled steel sheet excellent in balance between deep drawability and resistance to secondary-work embrittlement, and a method for manufacturing same. The following findings were obtained as a result:

In order to manufacture a continuously annealed cold-rolled steel sheet excellent in balance between deep drawability and resistance to secondary-work embrittlement, it is necessary to satisfy all of the following conditions (1) to (4) in IF steel comprising an ultra-low-carbon steel having a carbon content in steel of under 0.0030 wt. %:

(1) adding titanium (Ti) in an amount within a range of from 0.02 to 0.10 wt. %, more preferably, of from 0.02 to 0.07 wt. % to an ultra-low-carbon steel;

(2) causing titanium (Ti) remaining after the combination with nitrogen (N) and sulfur (S) in steel to combine with carbon (C) in steel to form titanium carbide (TiC), thereby completely fixing carbon in steel within the steel;

(3) adding boron (B) in an appropriate amount to a continuously cast steel slab to prevent the occurrence of surface defects such as pinholes in the continuously cast steel slab; i.e., adding boron in an amount within a range of from 0.0003 to 0.0010 wt. %, where the amount of added boron is determined depending on the content rate of carbon (C) to remaining titanium (Ti); and (4) more preferably, in a hot-rolling process of a continuously cast steel slab having a titanium (Ti) content and a boron (B) content determined as described above, carrying out a finishing-rolling at an appropriate reduction rate distribution, subjecting the resultant hot-rolled steel strip to a cold-rolling at an appropriate reduction rate, and subjecting the resultant cold-rolled steel strip to a continuous annealing under an appropriate condition, thereby preparing a continuously annealed cold-rolled steel sheet having a desirable microstructure and a desirable crystal texture.

The present invention was made on the basis of the above-mentioned findings. A continuously annealed cold-rolled steel sheet of the present invention excellent in balance between deep drawability and resistance to secondary-work embrittlement and a method for manufacturing same, are described below in detail.

The reasons of limiting the chemical composition of the continuously annealed cold-rolled steel sheet of the present invention excellent in balance between deep drawability and resistance to secondary-work embrittlement, are described below.

(1) Carbon (C):

The present invention has an objective to precipitate all carbon in steel in the form of titanium carbide (TiC), or in the form of titanium carbosulfide (Ti[C. S]) with titanium sulfide (TiS) as a nucleus thereof. The reason is that simultaneous provision of an excellent deep drawability and an excellent non-aging property is an essential prerequisite for the continuously annealed cold-rolled steel sheet of the present invention, which uses Ti-IF steel as a basic material. A lower carbon content is therefore more desirable, requiring a smaller amount of added titanium. A lower carbon content requires however a higher refining cost. With a carbon content of at least 0.0030 wt. %, however, it is impossible to precipitate all carbon in steel in the form of titanium carbide (TiC). The carbon content should therefore be limited to under 0.0030 wt. %. With a carbon content of up to 0.0015 wt. %, furthermore, deep drawability of the continuously annealed cold-rolled steel sheet is further improved. Carbon is on the other hand an element effective in refining crystal grains of the steel sheet during the hot-rolling. In order to achieve a sufficient refining effect of crystal grains as described above, the carbon content should be at least 0.0010 wt. %. More preferably, therefore, the carbon content should be limited within a range of from 0.0010 to 0.0015 wt. %.

(2) Silicon (Si):

In the present invention, silicon is one of incidental impurities. The silicon content should therefore be preferably the lowest possible. A lower silicon content leads however to a higher refining cost of steel. In order to keep a satisfactory ductility of the continuously annealed cold-rolled steel sheet, on the other hand, the silicon content should be limited to up to 0.05 wt. %. The silicon content should therefore be limited to up to 0.05 wt. %.

(3) Manganese (Mn):

Manganese has a function of restraining hot shortness of a steel sheet. With a manganese content of under 0.05 wt. %, however, a desired effect as described above is unavailable. With a manganese content of over 0.20 wt. %, on the other hand, a desirable crystal texture cannot be achieved, thus making it impossible to ensure an excellent deep drawability. The manganese content should therefore be limited within a range of from 0.05 to 0.20 wt. %.

(4) Phosphorus (P):

Phosphorus is one of incidental impurities detrimental to resistance to secondary-work embrittlement. In the present invention, in which boron is an essential element, it is not necessary to reduce the phosphorus content to a very low level. In order to improve deep drawability of a continuously annealed cold-rolled steel sheet, however, the phosphorus content should be reduced to within a range in which an adverse effect on ductility of the cold-rolled steel sheet is negligible. The phosphorus content should therefore be limited to up to 0.02 wt. %.

(5) Sulfur (S):

Sulfur is one of incidental impurities. Sulfur forms titanium sulfide (TiS) through the combination with titanium. The remaining titanium content after subtracting the amount of titanium consumed for the combination with nitrogen and sulfur in steel from the total amount of titanium (hereinafter referred to as the "effective titanium content", and expressed as Ti*), is calculated by the following formula (2') in accordance with the chemical equivalent thereof:

$$Ti^*=Ti-(48/14)N-(48/32)S \quad (2').$$

As is clear from the formula (2'), a higher sulfur content corresponds to a reduced effective titanium content (Ti*), and this makes it difficult to fix carbon in steel in the form of titanium carbide (TiC) within steel. The sulfur content should therefore be preferably the lowest possible. However, because a lower sulfur content leads to a higher refining cost of steel, it is necessary to limit the sulfur content within a range in which properties of the cold-rolled steel sheet are not impaired. The sulfur content should therefore be limited to up to 0.015 wt. %, and more preferably, to up to 0.010 wt. %.

(6) Acid-soluble aluminum (sol.Al):

Acid-soluble aluminum (sol.Al) is contained in steel as a remainder of aluminum used as a deoxidizer of molten steel. With a content of soluble aluminum of under 0.025 wt. %, not only deoxidation of molten steel is insufficient, but also added titanium is oxidized by oxygen in steel and consumed. With a soluble aluminum content of over 0.06 wt. %, on the other hand, alumina ($Al_2O_3$) produced in a large quantity tends to easily cause the clogging of a bore of a pouring nozzle of a tundish during the continuous casting of molten steel. The soluble aluminum content should therefore be limited within a range of from 0.025 to 0.06 wt. %.

(7) Nitrogen (N):

Nitrogen is one of incidental impurities. For the full display of properties of IF steel, the nitrogen content should preferably be the lowest possible. A lower nitrogen content however results in a higher refining cost of steel. Nitrogen shows a strong tendency toward forming titanium nitride (TiN), on the other hand, as a result of an easy combination with titanium. Nitrogen thus combines with titanium in steel to reduce the above-mentioned effective titanium content (Ti*). The upper limit value of the nitrogen content should therefore be determined depending upon the upper limit value of the sulfur content and the lower limit value of the titanium content. It is necessary not to allow solid-solution nitrogen to remain in steel even when the upper limit value of the sulfur content is 0.015 wt. % and the lower limit value of the titanium content is 0.02 wt. %. The nitrogen content in steel should therefore be limited to up to 0.030 wt. %.

(8) Titanium (Ti):

In the present invention, titanium is an essential element for forming titanium carbonitride (Ti(C. N)) which is indispensable for IF steel. On the other hand, however, titanium causes more frequent occurrence of surface defects such as pinholes, which are caused by titanium oxide, on the surface of a continuously cast slab along with the increase in the titanium content. Particularly when applying a method known as the hot-direct rolling method comprising directly hot-rolling a continuously cast slab without reheating same in a heating furnace, it is important to control the titanium content within an appropriate range.

FIG. 1 is a graph illustrating the effect of a titanium content on a density of produced surface defects (i.e., pinholes) in a continuously cast steel slab prepared from each of Ti-IF steel, Ti-Nb-IF steel and Ti-B-IF steel. In FIG. 1, the niobium content in Ti-Nb-IF steel is changed within a range of from 0.005 to 0.015 wt. %, the boron content in Ti-B-IF steel, within a range of from 0.0003 to 0.0010 wt. %, and the titanium content in each IF steel, within a range of from 0.01 to 0.10 wt. %, respectively.

In Ti-IF steel, as is clear from FIG. 1, pinholes are produced on the surface of the continuously cast steel slab even with a low titanium content of 0.01 wt. %, and the density of produced pinholes sharply increases according as the titanium content becomes higher. In Ti-Nb-IF steel, although the density of produced pinholes is far lower than that in Ti-IF steel, pinholes are produced as in Ti-IF steel, by adding titanium in such a slight amount as 0.01 wt. % even with a low niobium content as within a range of from 0.005 to 0.015 wt. %, and the occurrence thereof cannot be completely prevented. In Ti-B-IF steel, in contrast, it is possible to largely inhibit the occurrence of pinholes even by adding titanium in a slight amount if the boron content is within a range of from 0.0003 to 0.0010 wt. %. In inhibiting the occurrence pinholes on the surface of a continuously cast steel slab of IF steel, therefore, addition of boron in an appropriate amount to Ti-IF steel is effective. Therefore, in the present invention, boron is added in an amount within a range of from 0.0003 to 0.0010 wt. %, as described in detail later.

In Ti-B-IF steel, as is clear from FIG. 1, when a titanium content is up to 0.10 wt. %, it is possible to reduce the density of produced pinholes on the slab surface to two pinholes/$m^2$ admissible in practice. With a titanium content of under 0.07 wt. %, furthermore, a density of produced pinholes of up to 0.5/$m^2$ on the slab surface is achievable, thus permitting the inhibition thereof to a level posing no problem in practice. With a titanium content of under 0.05 wt. %, the density of produced pinholes on the slab surface becomes zero, thus giving a slab having a further desirable surface condition.

Titanium is on the other hand a strong element forming nitride and sulfide in steel. Particularly, titanium combines with nitrogen in steel within a high-temperature region to precipitate nitrogen in the form of coarse titanium nitride (TiN). By causing the precipitation of nitrogen remaining in steel in the form of aluminum nitride (AlN) after the hot-rolling, furthermore, the fluctuation of quality in the longitudinal direction of a hot-rolled steel coil can be restrained. After the precipitation of nitride and sulfide, titanium remaining in steel combines with carbon in steel, thus causing the precipitation of carbon in the form of titanium carbide (TiC). In order to fix carbon in steel, therefore, the titanium content should be at least 0.02 wt. %.

The titanium content should therefore be limited within a range of from 0.02 to 0.10 wt. %, and more preferably, from 0.02 to under 0.07 wt. %.

(9) Boron (B):

In the present invention, boron is an essential element in steel. More specifically, by adding boron in an appropriate amount to Ti-IF steel which is available by adding titanium in an appropriate amount to an ultra-low-carbon steel, it is possible to obtain a continuously annealed cold-rolled steel sheet having a far improved balance between deep drawability and resistance to secondary-work embrittlement, as compared with a conventional Ti-IF steel, while reducing surface defects of a slab, as shown in FIG. 1.

Figure 2:
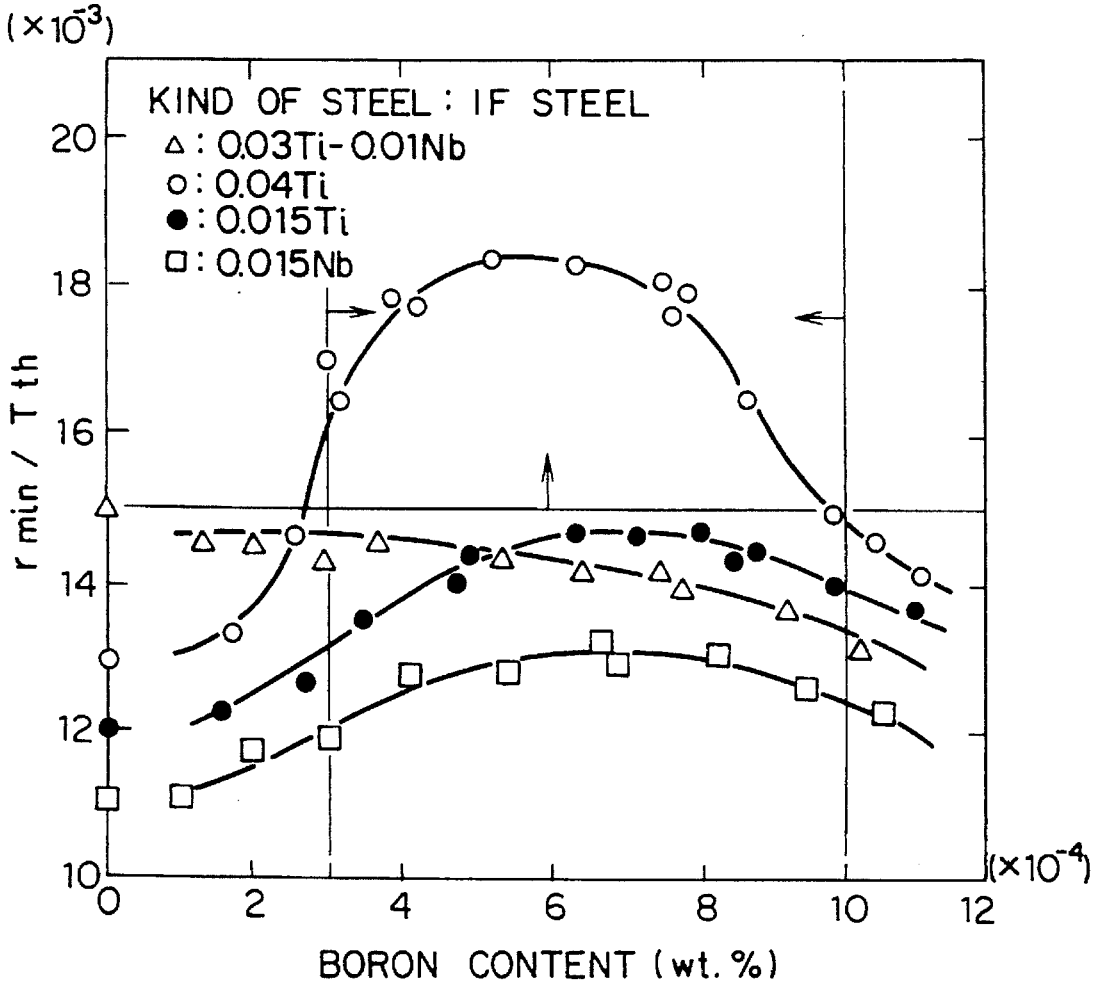
FIG. 2 is a graph illustrating the effect of a boron content in a continuously annealed cold-rolled steel sheet on an index rmin/Tth (i.e., the ratio of a minimum Lankford value (rmin) from among Lankford values (r-values) in three directions within a plane (0°, 45° and 90°, respectively, to the rolling direction) to a secondary-work embrittlement transition temperature (Tth)(K) in the continuously annealed cold-rolled steel sheet prepared from each of Ti-IF steel, Nb-IF steel and Ti-Nb-IF steel, which are added with boron.

FIG. 2 is a graph illustrating the effect of the boron content in a continuously annealed cold-roleld steel sheet on the balance between deep drawability and resistance to secondary-work embrittlement in the continuously annealed cold-rolled steel sheet prepared from each of Ti-IF steel, Nb-IF steel and Ti-Nb-IF steel, which are added with boron in an amount within a range of from 0.0001 to 0.0011 wt. %. In FIG. 2, Ti-IF steel has a titanium content of 0.04 wt. % (marks ○ in FIG. 2) or 0.015 wt. % (marks ● in FIG. 2); Nb-IF steel has a niobium content of 0.015 wt. % (marks □ in FIG. 2); and Ti-Nb-IF steel has a titanium content of 0.03 wt. % and a niobium content of 0.01 wt. % (marks Δ in FIG. 2).

Now, the method of evaluation of deep drawability and resistance to secondary-work embrittlement in the present invention will be described below.

For deep drawability, a Lankford test was carried out for each of three directions within a plane (0°, 45° and 90°, respectively, to the rolling direction) of a continuously annealed cold-rolled steel sheet, and deep drawability was evaluated by means of a minimum Lankford value (rmin) from among Lankford values (r-values) in the three directions.

Resistance to secondary-work embrittlement was evaluated through a test of resistance to secondary-work embrittlement as described below. More specifically, disk-shaped test pieces in a prescribed number having a prescribed diameter were sampled from each of various continuously annealed cold-rolled steel sheets, and then, each test piece was drawn into a cup at a drawing ratio (i.e., a ratio of a diameter of a test piece to a diameter of a punch) of 2.2. Then, a truncated conical punch having prescribed dimensions was pushed into an opening of each of the resultant cups at each of various test temperatures. A ductile/brittle transition temperature of each of the above-mentioned cups (hereinafter referred to as the "secondary-work embrittlement transition temperature(K)" and expressed as "Tth") was thus determined, and resistance to secondary-work embrittlement was evaluated the thus determined secondary-work embrittlement transition temperature(K).

Figure 6:
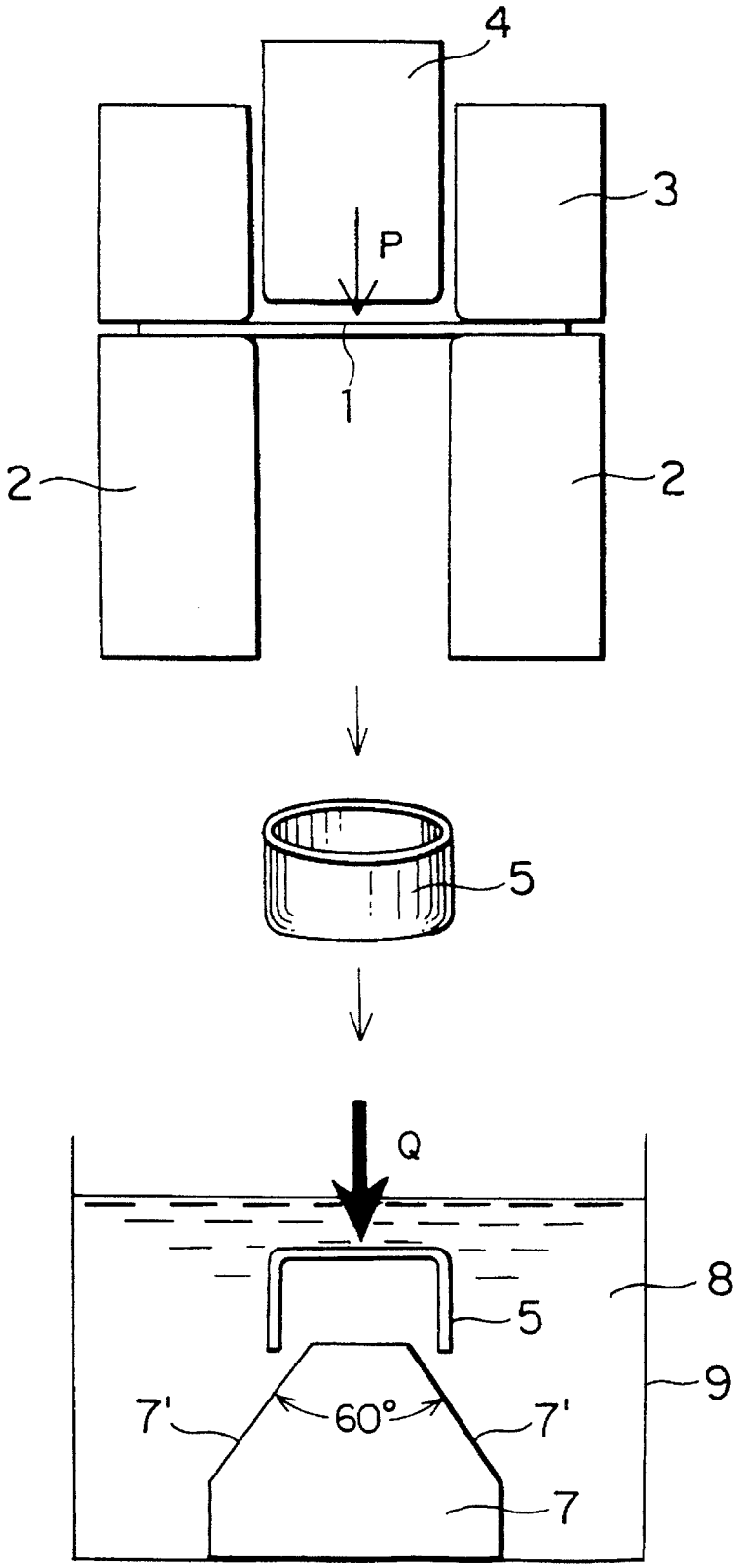
FIG. 6 is a schematic descriptive view illustrating a test method of resistance to secondary-work embrittlement.

FIG. 6 is a schematic descriptive view illustrating a test method of resistance to secondary-work embrittlement. As shown in FIG. 6, a disk-shaped test piece 1 having a diameter of 110 mm sampled from each of various continuously annealed cold-rolled steel sheets, is placed on a die 2 having a prescribed diameter, and a load P is applied onto the test piece 1 in the arrow direction by means of a punch 4 having a diameter of 50 mm while pressing a peripheral edge portion of the test piece 1 by means of a wrinkle inhibiting means 3 applied with a prescribed load, to form the test piece 1 into a cup 5 at a drawing ratio of 2.2.

On the other hand, a truncated conical punch 7 is secured in a container 9 with the head thereof directed upward. Then, the thus formed cup 5 is placed on the punch 7 to cover same with an opening of the cup 5 directed downward, and the peripheral edge 6 of the opening of the cup 5 is brought into contact with a conical surface 7' of the punch 7. Then, the container 9 is filled with a refrigerant 8 (for example, a solution of liquid nitrogen and ethyl alcohol mixed at a rate depending upon a test temperature), and the cup 5 is immersed into the refrigerant 8. Then, a load Q is applied onto the bottom of the cup 5 from outside in the arrow direction, to push the head of the punch 7 into the cup 5. Then, the temperature of the cup 5 at the moment when the cup 5 has been brittle-fractured, i.e., a secondary-work embrittlement transition temperature (Tth) (K), is determined. The head of the punch 7 has a nose angle of 60°.

The ratio of the minimum Lankford value (rmin) separately determined to the secondary-work embrittlement transition temperature (Tth) i.e., the index rmin/Tth, is employed as an index representing a balance between deep drawing and resistance to secondary-work embrittlement.

As is clear from FIG. 2, in continuously annealed cold-rolled steel sheets made of Ti-Nb-IF steel (marked Δ), Nb-IF steel (marked □), and 0.015 wt. % Ti-IF steel (marked ●), all having a chemical composition outside the scope of the present invention, it is impossible to obtain an excellent balance between deep drawability and resistance to secondary-work embrittlement which satisfies the index rmin/Tth≧0.015 even by adding boron. In contrast, continuously annealed cold-rolled steel sheets made of Ti-B-IF steel (marked ○) having a chemical composition within the scope of the present invention, prepared by adding boron in an amount within a range of from 0.0003 to 0.0010 wt. % to Ti-IF steel which is prepared by adding 0.04 wt. % titanium to an ultra-low-carbon steel, have an excellent balance between deep drawability and resistance to secondary-work embrittlement, as typically represented by the index rmin/Tth≧0.015.

The continuously annealed cold-rolled steel sheet excellent in balance between deep drawability and resistance to secondary-work embrittlement, can be manufactured only by using Ti-B-IF steel, as a material, in which titanium in an appropriate amount and boron in an appropriate amount are added to an ultra-low-carbon steel. In order to achieve the objects of the present invention, therefore, Ti-B-IF steel must be used as a basic material, and the boron content should be limited within a range of from 0.0003 to 0.0010 wt. %.

An object of the present invention is to obtain a continuously annealed cold-rolled steel sheet having a value of the index rmin/Tth, which represents balance between deep drawability and secondary-work embrittlement, of at least 0.015. It is not necessary to specifically define the upper limit value of the index rmin/Tth. The steel sheet to be provided by the present invention is a continuously annealed cold-rolled steel sheet made of IF steel. The premise is therefore that the minimum Lankford value (rmin) for the continuously annealed cold-rolled steel sheet of the present invention is on a high level even within a range of rmin available for a conventional continuously annealed cold-rolled steel sheet, and the lowest possible secondary-work brittleness transition temperature (Tth)(K) is a target. It makes therefore no sense to set an upper limit value of the index rmin/Tth for the continuously annealed cold-rolled steel sheet of the present invention.

For a continuously annealed cold-rolled steel sheet made of Ti-B-IF steel, tests were carried out on deep drawability and resistance to secondary-work embrittlement. The results are shown in FIGS. 3 and 4.

Figure 3:
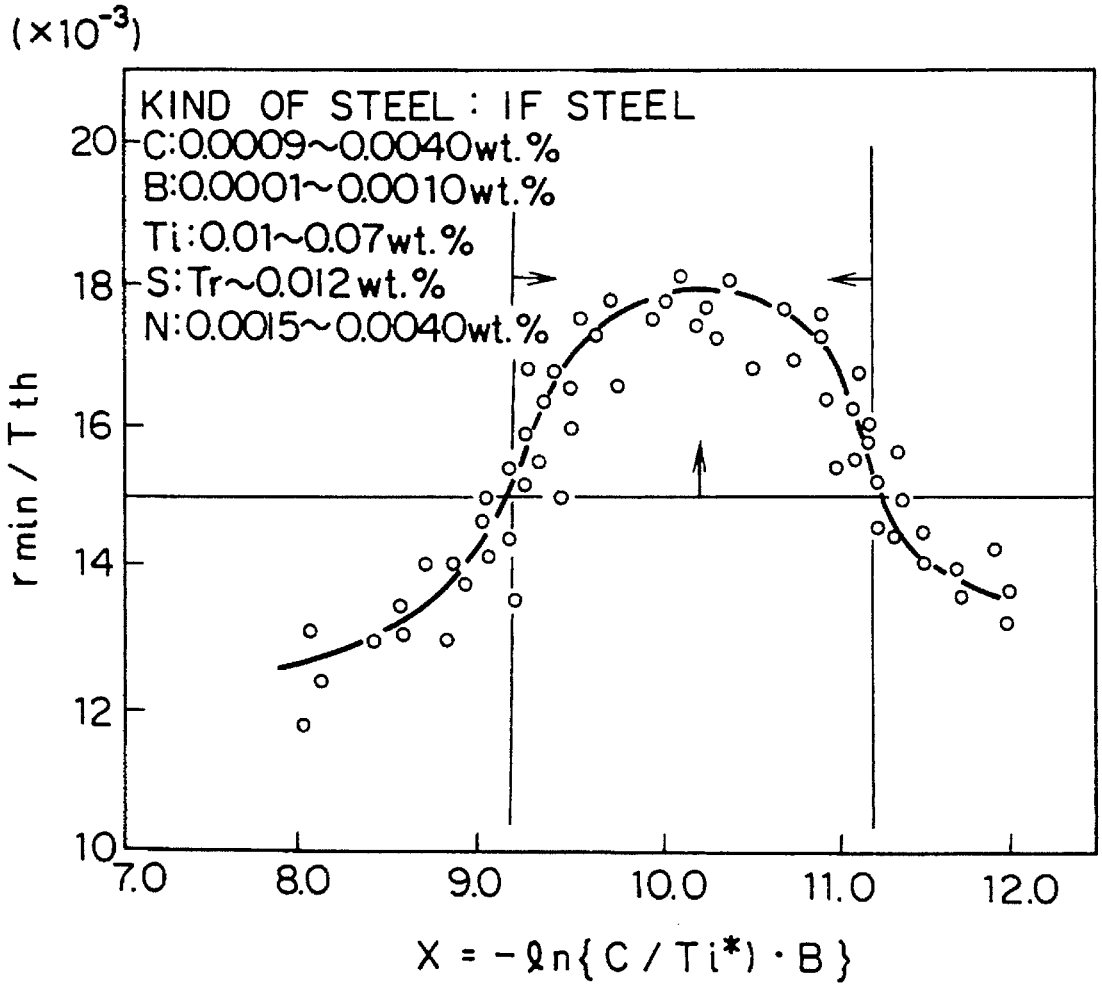
FIG. 3 is a graph illustrating the relationship between an index rmin/Tth (i.e., the ratio of a minimum Lankford value (rmin) from among Lankford values (r-values) in three directions within a plane (0°, 45° and 90°, respectively, to the rolling direction) to a secondary-work embrittlement transition temperature (Tth)(K), on the one hand, and an index X (i.e., an index representing the content rate of titanium to boron, depending upon a chemical composition of a steel sheet), on the other hand, in a continuously annealed cold-rolled steel sheet prepared from Ti-B-IF steel.
Figure 4:
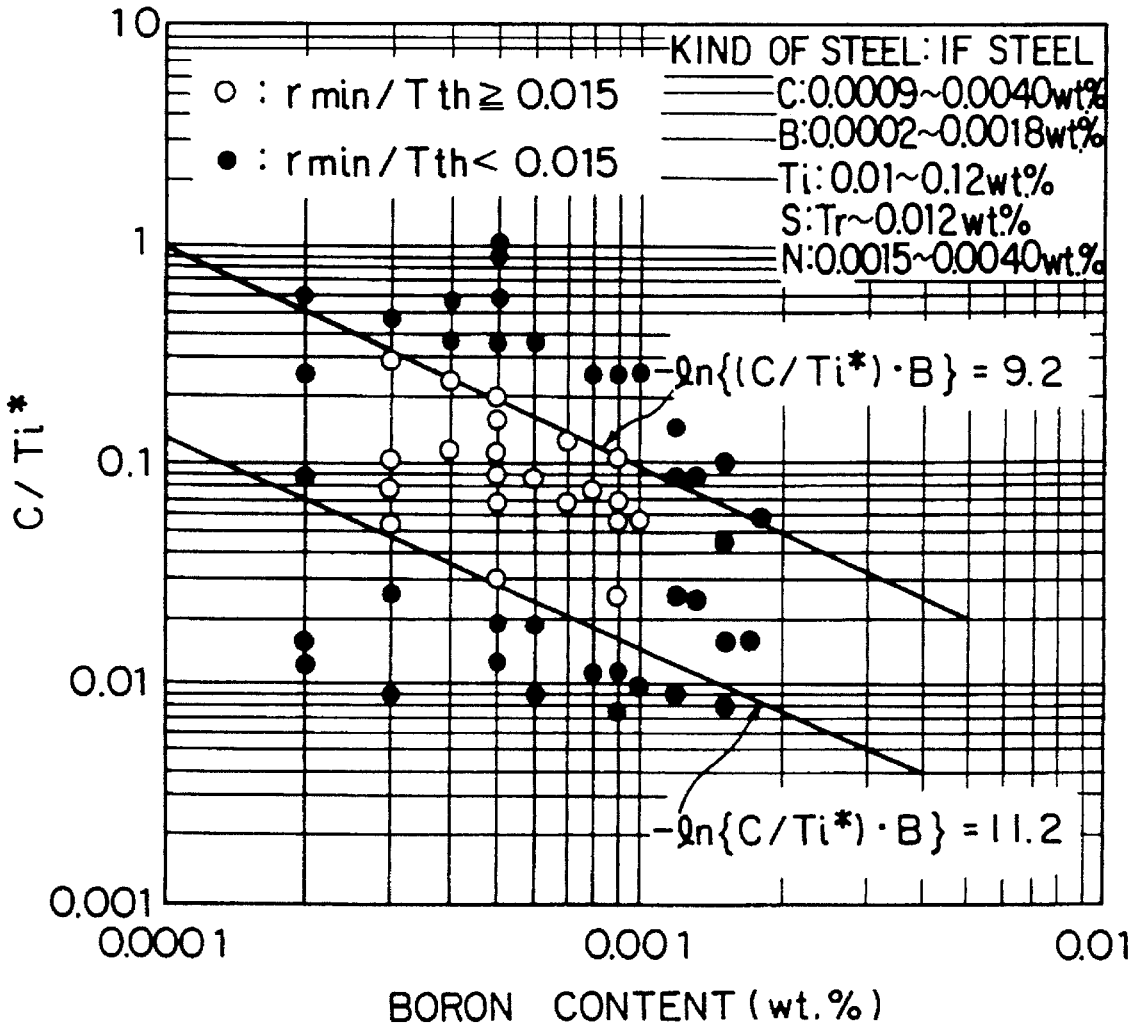
FIG. 4 is a graph illustrating the effect of C/Ti* (where, Ti*=Ti−(48/14)N−(48/32)S>0) of a steel sheet and a boron content in the steel sheet, on an index rmin/Tth (i.e., the ratio of a minimum Lankford value (rmin) from among Lankford values (r-values) in three directions within a plane (0°, 45° and 90°, respectively, to the rolling direction)to a secondary-work embrittlement transition temperature (Tth)(K) in a continuously annealed cold-rolled steel sheet prepared from Ti-B-IF steel.

FIG. 3 illustrates the results of test in a case where Ti-B-IF steel having a chemical composition within a range shown in Table 1 is used. FIG. 4 illustrates the test results in a case where Ti-B-IF steel having a chemical composition within a range shown in Table 2 is used.

TABLE 1

(wt. %)

| C | B | Ti | S | N |
|---|---|---|---|---|
| 0.0009~ 0.0040 | 0.0001~ 0.0010 | 0.01~ 0.07 | tr.~ 0.012 | 0.0015~ 0.0040 |

TABLE 2

(wt. %)

| C | B | Ti | S | N |
|---|---|---|---|---|
| 0.0009~ 0.0040 | 0.0002~ 0.0018 | 0.01~ 0.12 | tr.~ 0.012 | 0.0015~ 0.0040 |

An index X representing a content rate of titanium to boron described below was adopted in order to clarify the effects of contents of titanium, boron, carbon, nitrogen and sulfur in steel on the index rmin/Tth, which represents balance between deep drawability and resistance to secondary-work embrittlement. More specifically, as described above as to the reasons of limiting the chemical composition of the continuously annealed cold-rolled steel sheet of the present invention, titanium is consumed primarily for the formation of titanium nitride (TiN) and titanium sulfide (TiS) among others, and the remaining titanium forms titanium carbide (TiC) and titanium carbosulfide (Ti[C. S]). The appropriate titanium content in the continuously annealed cold-rolled steel sheet of the present invention should therefore satisfy the limited relationships with the contents of nitrogen, sulfur and carbon. In addition, the appropriate boron content should satisfy the limited relationships with the contents of the above-mentioned elements.

The above-mentioned effective titanium content (Ti*) was therefore expressed by the following formula (2), and the above-mentioned index X representing the content rate of titanium to boron was calculated by the following formula (1):

$$X=-\ln\{(C/Ti^*)B\} \quad (1)$$

$$Ti^*=Ti-(48/14)N-(48/32)S>0 \quad (2)$$

FIG. 3 is a graph illustrating the effect of the index X on the index rmin/Tth which represents balance between deep drawability and resistance to secondary-work embrittlement, when changing the value of index X within a range of from 8.0 to 12.0 in a continuously annealed cold-rolled steel sheet made of Ti-B-IF steel. As is clear from FIG. 3, the index rmin/Tth takes a value of at least 0.015 when the value of index X is within a range of from 9.2 to 11.2, thus providing a continuously annealed cold-rolled steel sheet excellent in balance between deep drawability and resistance to secondary-work embrittlement.

FIG. 4 is a graph illustrating, for a continuously annealed cold-rolled steel sheet made of Ti-B-IF steel, the effect of C/Ti* of the steel sheet and a boron content in the steel sheet, on the index rmin/Tth. In FIG. 4, the mark ○ indicates the index rmin/Tth≧0.015, and the mark ● indicates the index rmin/Tth<0.015. As is clear from FIG. 4, the boron content is within a range of from 0.0003 to up to 0.0010 wt. % for all the marks ○, which are present within a region enclosed by the straight line "$-\ln\{(C/Ti^*)B\}=11.2$" and the straight line "$-\ln\{(C/Ti^*)B\}=9.2$". More specifically, FIG. 4 shows that a continuously annealed cold-rolled steel sheet excellent in balance between deep drawability and resistance to secondary-work embrittlement, which satisfies the index rmin/Tth≧0.0015, can be obtained only when the boron content is within a range of from 0.0003 to 0.0010 wt. % and the value of index X is within a range of from 9.2 to 11.2.

In the chemical composition of the continuously annealed cold-rolled steel sheet of the present invention, therefore, the boron content should be limited within a range of from 0.0003 to 0.0010 wt. %, and the relationship between the contents of titanium, boron, carbon, nitrogen and sulfur should be limited so that the index X, which represents the content rate of titanium to boron, is within a range of from 9.2 to 11.2.

Now, the reasons of limiting the conditions of the process subsequent to the hot-rolling of the steel slab having the above-mentioned chemical composition within the ranges as described above in the present invention, are described below.

In order to achieve the objects of the present invention, as described above as to the findings, it is important to carry out the finishing-rolling with an appropriate reduction rate distribution in the hot-rolling process of the steel slab so as to obtain a continuously annealed cold-rolled steel sheet having a desirable microstructure and a desirable crystal texture. As a result of extensive studies, an appropriate reduction rate distribution as described below was derived for a plurality of roll stands of the finishing-rolling train of the hot-rolling mill.

on the basis of the findings that the reduction rate distribution for the third and second roll stands on the exit side of the finishing-rolling train, among a plurality of roll stands of the finishing-rolling train of the hot-rolling mill, is particularly important, a reduction rate distribution function Y, as expressed by the following formula (3), was determined:

$$Y=\{\ln(t_{n-3}/t_{n-2})+\ln(t_{n-2}/t_{n-1})\}/\ln(t_0/t_n) \quad (3)$$

where, n: number of roll stands of the finishing-rolling train, $t_0$: thickness of a steel sheet on the entry side of the first roll stand of the finishing-rolling train, $t_{n-3}$: thickness of the steel sheet on the exit side of the n-3-th roll stand of the finishing-rolling train, $t_{n-2}$: thickness of the steel sheet on the exit side of the n-2-th roll stand of the finishing-rolling train, $t_{n-1}$: thickness of the steel sheet on the exit side of the n-1-th roll stand of the finishing-rolling train, and $t_n$: thickness of the steel sheet on the exit side of the n-th roll stand of the finishing-rolling train.

A continuously annealed cold-rolled steel sheet was prepared by hot-rolling a steel slab having a value of index X, which represents a content rate of titanium to boron and calculated by the following formulae (1) and (2), within a range of from 9.2 to 11.2, at a finishing-rolling temperature within a range of from 880° to 920° C., then cold-rolling the resultant hot-rolled steel strip at an accumulative reduction rate of at least 70%, and then continuously annealing the resultant cold-rolled steel strip within a temperature region of from 750° C. to an $Ac_3$ transformation point:

TABLE 3

(wt. %)

| C | B | Ti | S | N |
|---|---|---|---|---|
| 0.0009~ 0.0040 | 0.0003~ 0.0010 | 0.02~ 0.07 | tr.~ 0.012 | 0.0015~ 0.0040 |

$$X=-\ln\{(C/Ti^*)B\} \quad (1)$$

in the formula (1):

$$Ti^*=Ti-(48/14)N-(48/32)S>0 \quad (2)$$

For a plurality of continuously annealed cold-rolled steel sheets thus prepared, tests were carried out on deep drawability and resistance to secondary-work embrittlement, and a value of the index rmin/Tth was determined for each such steel sheet. The results are shown in FIG. 5.

Figure 5:
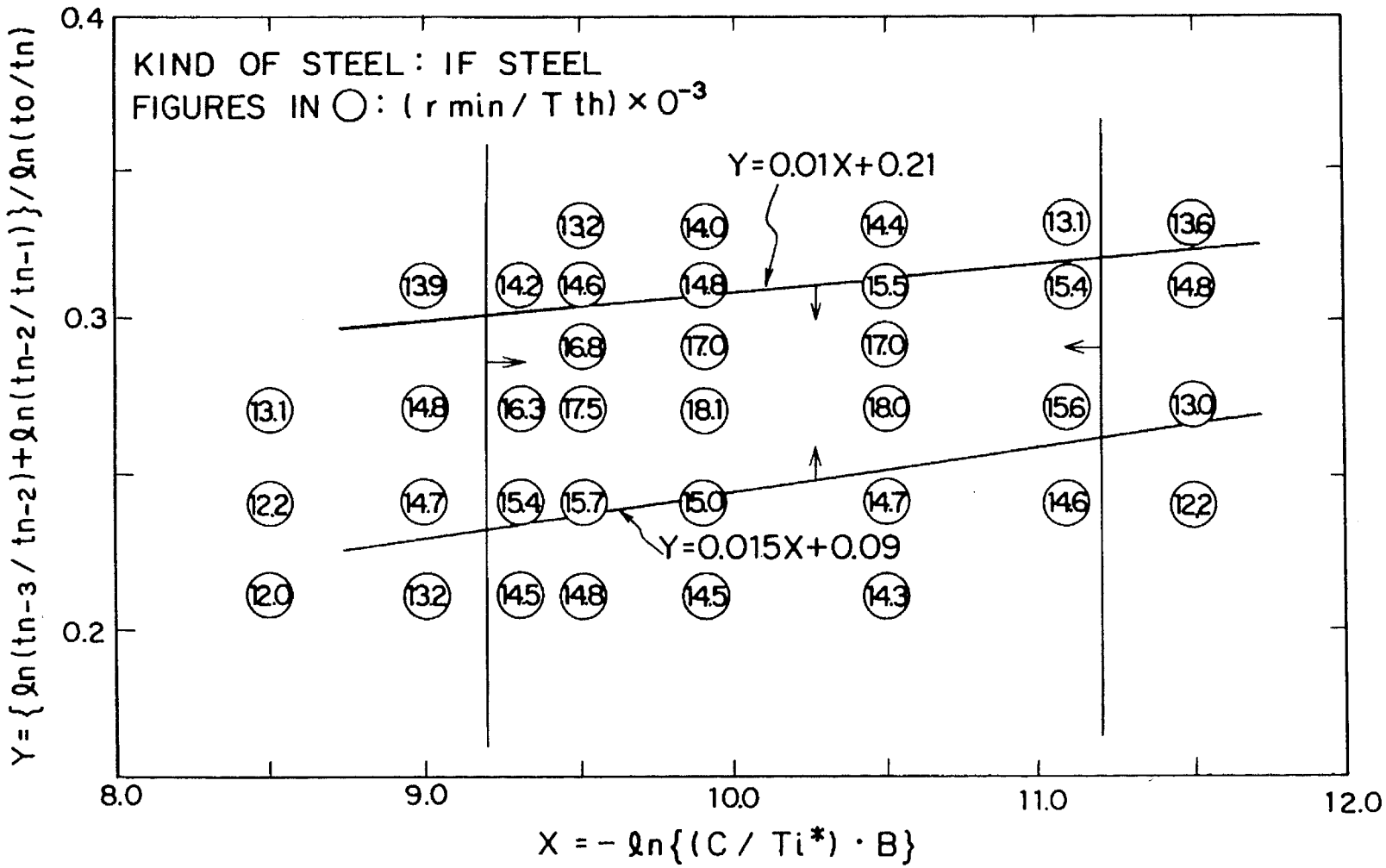
FIG. 5 is a graph illustrating the effect of a reduction rate distribution function Y at a roll stand of a finishing-rolling train of a hot-rolling mill ($\{\ln(t_{n-3}/t_{n-2})+\ln(t_{n-2}/t_{n-1})\}/\ln(t_0/t_n)$) and an index X (i.e., an index representing the content rate of titanium to boron, depending upon a chemical composition of a steel sheet), on an index rmin /Tth (i.e., the ratio of a minimum Lankford value (rmin) from among Lankford values (r-values) in three directions within a plane (0°, 45° and 90°, respectively, to the rolling direction) to a secondary-work embrittlement transition temperature (Tth)(K) in a continuously annealed cold-rolled steel sheet prepared from Ti-B-IF steel.

In FIG. 5, the abscissa represents the index $X=-\ln\{(C/Ti^*)B\}$, and the ordinate represents the function $Y=\{\ln(t_{n-3}/t_{n-2})+\ln(t_{n-2}/t_{n-1})\}/\ln(t_0/t_n)$. In FIG. 5, encircled figures represent values of the index rmin/Tth which represents balance between deep drawability and resistance to secondary-work embrittlement. More particularly, FIG. 5 is a graph illustrating values of the index rmin/Tth for continuously annealed cold-rolled steel sheets prepared from various combinations of values of the index X representing the content rate of titanium to boron, as calculated from the chemical composition of steel, on the one hand, and values of the reduction rate distribution function Y for the third and second roll stands on the exit side of the finishing-rolling train of the hot-rolling mill, on the other hand.

The following facts are clearly known from FIG. 5:

A continuously annealed cold-rolled steel sheet excellent in the value of the index rmin/Tth, which represents balance between deep drawability and resistance to secondary-work embrittlement, is available only within a range of specific combinations of values of the index X representing the content rate of titanium to boron, as calculated from the chemical composition of the steel sheet, on the one hand, and values of the reduction rate distribution function Y for the third and second roll stands on the exit side of the finishing-rolling train of the hot-rolling mill, on the other hand. More specifically, for a continuously annealed cold-rolled steel sheet excellent in balance between deep drawability and resistance to secondary-work embrittlement, which satisfies the index rmin/Tth≧0.015, the value of the index X is within a range of from 9.2 to 11.2, and in addition, the relationship between the reduction rate distribution function Y for a plurality of roll stands of the finishing-rolling train and the index X, lies within a region enclosed by a straight line Y=0.015X+0.09 and a straight line Y=0.01X+0.21.

Therefore, in the method for manufacturing the continuously annealed cold-rolled steel sheet of the present invention, the value of index X, which represents the content rate of titanium to boron, as calculated from the chemical composition of steel should be limited within a range of from 9.2 to 11.2, and in addition, the reduction rate distribution function Y for the third and second roll stands on the exit side of the finishing-rolling train of the hot-rolling mill should be limited so as to satisfy the following formula (4):

$$0.015X+0.09 \leqq Y \leqq 0.01X+0.21 \quad (4)$$

More specifically, if the hot-rolling of a steel slab is carried out within a range of Y<0.015X+0.09, it is difficult to sufficiently refine the structure of the hot-rolled steel sheet, and a desirable structure and desirable crystal texture of the continuously annealed cold-rolled steel sheet is unavailable, even when titanium and boron are contained in the steel slab. A satisfactory minimum Lankford value (rmin) cannot consequently be obtained in a continuously annealed cold-rolled steel sheet, thus making it impossible to obtain a continuously annealed cold-rolled steel sheet having an excellent value of the index rmin/Tth. When hot-finishing-rolling of the steel slab is carried out within a range of 0.01X+0.21<Y, on the other hand, a hot-working strain caused by the hot-rolling is applied concentrically onto the steel sheet in the third and second roll stands on the exit side of the finishing-rolling train of the hot-rolling mill, resulting in a refined structure and in an apparent development of a crystal texture having an orientation <110>/ND (abbreviation of "normal direction"). As a result, the minimum Lankford value (rmin-value) of the cold-rolled steel sheet decreases after the application of the continuous annealing treatment, thus making it impossible to obtain a continuously annealed cold-rolled steel sheet having an excellent value of the index rmin/Tth. When the steel slab is hot-finishing-rolled within a range of 0.01X+0.21<Y, it is necessary to increase the reduction rate for the third and second roll stands on the exit side of the finishing-rolling train of the hot-rolling mill, and this is not desirable from the practical point of view of the hot-rolling.

When carrying out the hot-finishing-rolling with a reduction rate distribution within the above-mentioned range of the present invention, with a finishing temperature of over 920° C., the structure of the hot-rolled steel sheet can not be sufficiently refined. With a finishing temperature of under 880° C., on the other hand, it is difficult to ensure a finishing temperature of at least an $Ar_3$ transformation point throughout all the portions of the hot-rolled steel sheet. The Lankford values of the continuously annealed cold-rolled steel sheet decreases at some portions, causing fluctuation of properties of the steel sheet. The finishing-temperature in the hot-rolling should therefore be limited within a range of from 880° to 920° C.

When the steel strip after the completion of the hot-finishing-rolling is coiled at a usual coiling temperature, no problem is caused in properties of the continuously annealed cold-rolled steel sheet so far as the chemical composition of the steel slab is within the scope of the present invention. With a view to preventing quality deterioration of the hot-rolled steel strip including that of the surface condition and the shape, however, the coiling temperature should preferably be within a range of from 560° to 660° C.

In order to achieve full display of various properties of the continuously annealed cold-rolled steel sheet of the present invention, it is necessary to ensure a stable and sound structure, and for this purpose, the accumulative reduction rate in the cold-rolling of the hot-rolled steel strip should be limited to at least 70%.

In order to make achieve full display of various properties of the continuously annealed cold-rolled steel sheet of the present invention, it is essential to continuously anneal the cold-rolled steel sheet. In this case, the continuous annealing temperature should be at least the recrystallization temperature. It is therefore necessary to carry out the continuous annealing at a temperature of at least 750° C. In order to avoid the decrease in Lankford value resulting from an α phase-γ phase transformation, on the other hand, the annealing temperature should be up to the $Ac_3$ transformation point. Since the minimum Lankford value (rmin) is improved mote according as the cold-rolled steel sheet is annealed at a higher temperature, it is preferable to continuously anneal the cold-rolled steel sheet at the highest possible temperature of up to the $Ac_3$ transformation point. The continuous annealing temperature of the cold-rolled steel should therefore be limited within a range of from 750° C. to the $Ac_3$ transformation point.

The continuously annealed cold-rolled steel sheet of the present invention is adaptable to the application of a surface treatment such as formation of a dip-plating layer, an electroplating layer or a plastic layer. Even if such a surface treatment is applied to the continuously annealed cold-rolled steel sheet of the present invention, the above-mentioned excellent balance between deep drawability and resistance to secondary-work embrittlement of the continuously annealed cold-rolled steel sheet of the present invention, is never impaired.

Now, the continuously annealed cold-rolled steel sheet of the present invention excellent in balance between deep drawability and resistance to secondary-work embrittlement and the method for manufacturing same, are described below further in detail by means of examples while comparing with examples for comparison.

EXAMPLES

A plurality of continuously cast steel slabs were prepared from steels I-1 to 1-13 having chemical compositions within the scope of the present invention as shown in Table 4, and steels C-1 to C-26 having chemical compositions outside the scope of the present invention as shown in Table 5. The thus prepared continuously cast slabs were then subjected to a hot-rolling, a cold-rolling and a continuous nnealing under prescribed conditions, to prepare various continuously annealed cold-rolled steel sheets. A sample was cut out from each of the thus prepared continuously annealed cold-rolled steel sheets, and a property test was carried out for each of these samples. Apart from the property test, the occurrence of surface defects of the continuously cast steel slabs was investigated. The methods and results of tests on deep drawability, resistance to secondary-work embrittlement, and balance between deep drawability and resistance to secondary-work embrittlement for each sample, and the method and result of investigation of the occurrence of pinholes as the surface defects of the slab, are described below.

EXAMPLE 1

Each of the continuously cast steel slabs made of the steels I-1 to 1-13, having chemical compositions within the scope of the present invention as shown in Table 4, and the continuously cast steel slabs made of the steels C-1 to C-26, having chemical compositions outside the scope of the present invention as shown in Tables 5(1) and 5(2), was heated to a temperature of 1,200° C., then hot-roughing-rolled to a thickness of 36 mm in a roughing-rolling train of a hot-rolling mill, then after adjusting a value of a reduction rate distribution in the third and second roll stands on the exit side of a finishing-rolling train having seven roll stands of the hot-rolling mill so that a value calculated by means of the above-mentioned reduction rate distribution function Y became 0.28, and then, hot-finishing-rolled at a finishing temperature within a range of from 890° to 920° C. and a coiling temperature of 620° C., to prepare a hot-rolled steel strip having a thickness of 3.2 mm. Then, the thus prepared hot-rolled steel strip was pickled, and then cold-rolled to prepare a cold-rolled steel strip having a thickness of 0.8 mm. Then, the thus prepared cold-rolled steel strip was continuously annealed at a temperature within a range of from 840° to 850° C., and then temper-rolled at a reduction rate of 0.5%, thereby obtaining continuously annealed cold-rolled steel sheets within the scope of the present invention (hereinafter referred to as the "continuously annealed cold-rolled steel sheets of the invention") Nos. 1 to 13, prepared under the manufacturing conditions within the scope of the present invention from the steel slabs having the chemical compositions within the scope of the present invention, and continuously annealed cold-rolled steel sheets outside the scope of the present invention (hereinafter referred to as the "continuously annealed cold-rolled steel sheets for comparison") Nos. 14 to 39, prepared under the manufacturing conditions within the scope of the present invention from the steel slabs having the chemical compositions outside the scope of the present invention.

TABLE 4

| Kind of | Chemical composition (wt. %) | | | | | | | | | | | | |
|---|---|---|---|---|---|---|---|---|---|---|---|---|---|
| steel | C | Si | Mn | P | S | sol.Al | N | Ti | Nb | B | Ti* | C/Ti* | X |
| I-1 | 0.0011 | 0.01 | 0.12 | 0.013 | 0.005 | 0.032 | 0.0023 | 0.021 | tr | 0.0004 | 0.0056 | 0.196 | 9.454 |
| I-2 | 0.0024 | 0.02 | 0.11 | 0.012 | 0.006 | 0.031 | 0.0026 | 0.028 | tr | 0.0003 | 0.0101 | 0.238 | 9.547 |
| I-3 | 0.0019 | 0.01 | 0.05 | 0.011 | 0.008 | 0.042 | 0.0021 | 0.029 | tr | 0.0005 | 0.0098 | 0.194 | 9.241 |
| I-4 | 0.0012 | 0.04 | 0.15 | 0.006 | 0.006 | 0.038 | 0.0021 | 0.043 | tr | 0.0004 | 0.0268 | 0.045 | 10.93 |
| I-5 | 0.0022 | 0.02 | 0.06 | 0.013 | 0.007 | 0.042 | 0.0019 | 0.042 | tr | 0.0006 | 0.025 | 0.088 | 9.848 |
| I-6 | 0.0019 | 0.03 | 0.09 | 0.011 | 0.007 | 0.046 | 0.0018 | 0.028 | tr | 0.0006 | 0.0113 | 0.168 | 9.204 |
| I-7 | 0.0021 | 0.01 | 0.06 | 0.011 | 0.006 | 0.045 | 0.0022 | 0.041 | tr | 0.0004 | 0.0245 | 0.086 | 10.28 |
| I-8 | 0.0015 | 0.01 | 0.09 | 0.008 | 0.006 | 0.052 | 0.0018 | 0.038 | tr | 0.0006 | 0.0228 | 0.066 | 10.14 |
| I-9 | 0.0018 | 0.02 | 0.11 | 0.016 | 0.012 | 0.045 | 0.0019 | 0.056 | tr | 0.0006 | 0.0315 | 0.057 | 10.28 |
| I-10 | 0.0021 | 0.01 | 0.13 | 0.008 | 0.011 | 0.042 | 0.0021 | 0.065 | tr | 0.0005 | 0.0413 | 0.051 | 10.58 |
| I-11 | 0.0028 | 0.02 | 0.12 | 0.017 | 0.005 | 0.028 | 0.0019 | 0.055 | tr | 0.0004 | 0.041 | 0.068 | 10.51 |
| I-12 | 0.0021 | 0.02 | 0.08 | 0.016 | 0.014 | 0.033 | 0.0021 | 0.064 | tr | 0.0005 | 0.0358 | 0.059 | 10.44 |
| I-13 | 0.0024 | 0.01 | 0.15 | 0.013 | 0.012 | 0.045 | 0.0025 | 0.095 | tr | 0.0005 | 0.0684 | 0.035 | 10.95 |

TABLE 5 (1)

| Kind of steel | Chemical composition (wt. %) | | | | | | | | | | | | |
|---|---|---|---|---|---|---|---|---|---|---|---|---|---|
| | C | Si | Mn | P | S | sol.Al | N | Ti | Nb | B | Ti* | C/Ti* | X |
| C-1 | 0.0019 | 0.02 | 0.06 | 0.018 | 0.012 | 0.022 | 0.0018 | 0.033 | tr | 0.0006 | 0.0088 | 0.215 | 8.955 |
| C-2 | 0.0024 | 0.03 | 0.13 | 0.018 | 0.010 | 0.028 | 0.0036 | 0.019 | tr | 0.0012 | −0.008 | — | — |
| C-3 | 0.0018 | 0.02 | 0.20 | 0.015 | 0.008 | 0.020 | 0.0027 | 0.008 | tr | 0.0011 | −0.013 | — | — |
| C-4 | 0.0017 | 0.01 | 0.20 | 0.007 | 0.007 | 0.030 | 0.0028 | 0.006 | tr | 0.0005 | −0.014 | — | — |
| C-5 | 0.001 | 0.02 | 0.15 | 0.008 | 0.006 | 0.035 | 0.0024 | 0.018 | tr | 0.0002 | 0.0008 | 1.296 | 8.258 |
| C-6 | 0.0032 | 0.01 | 0.15 | 0.007 | 0.005 | 0.04 | 0.0017 | 0.027 | tr | 0.0008 | 0.0137 | 0.234 | 8.583 |
| C-7 | 0.0031 | 0.02 | 0.21 | 0.016 | 0.006 | 0.053 | 0.0025 | 0.024 | tr | tr | 0.0064 | 0.482 | — |
| C-8 | 0.0033 | 0.02 | 0.23 | 0.016 | 0.007 | 0.043 | 0.002 | 0.017 | tr | tr | −0.002 | — | — |
| C-9 | 0.0027 | 0.03 | 0.13 | 0.024 | 0.008 | 0.062 | 0.0026 | 0.062 | tr | tr | 0.0411 | 0.066 | — |
| C-10 | 0.0019 | 0.01 | 0.08 | 0.018 | 0.004 | 0.026 | 0.0024 | 0.045 | tr | 0.0002 | 0.0308 | 0.062 | 11.3 |
| C-11 | 0.0042 | 0.01 | 0.08 | 0.014 | 0.004 | 0.035 | 0.0024 | 0.037 | tr | 0.0008 | 0.0228 | 0.184 | 8.821 |
| C-12 | 0.0021 | 0.04 | 0.05 | 0.012 | 0.010 | 0.035 | 0.0023 | 0.047 | tr | 0.0012 | 0.0241 | 0.087 | 9.166 |
| C-13 | 0.0018 | 0.01 | 0.11 | 0.017 | 0.007 | 0.044 | 0.0028 | 0.042 | tr | 0.0015 | 0.0219 | 0.082 | 9.001 |

TABLE 5 (2)

| Kind of steel | Chemical composition (wt. %) | | | | | | | | | | | | |
|---|---|---|---|---|---|---|---|---|---|---|---|---|---|
| | C | Si | Mn | P | S | sol.Al | N | Ti | Nb | B | Ti* | C/Ti* | X |
| C-14 | 0.0018 | 0.02 | 0.12 | 0.014 | 0.006 | 0.046 | 0.0023 | 0.018 | tr | 0.0016 | 0.0011 | 1.615 | 5.958 |
| C-15 | 0.0027 | 0.01 | 0.17 | 0.012 | 0.007 | 0.044 | 0.0023 | 0.005 | tr | 0.0005 | −0.013 | — | — |
| C-16 | 0.0026 | 0.01 | 0.15 | 0.009 | 0.005 | 0.039 | 0.0025 | 0.025 | 0.011 | tr | 0.0089 | 0.291 | — |
| C-17 | 0.0018 | 0.01 | 0.15 | 0.008 | 0.005 | 0.044 | 0.0017 | 0.031 | 0.012 | tr | 0.0177 | 0.102 | — |
| C-18 | 0.0016 | 0.02 | 0.12 | 0.01 | 0.005 | 0.052 | 0.0022 | 0.036 | 0.008 | 0.0006 | 0.021 | 0.076 | 9.991 |
| C-19 | 0.0023 | 0.01 | 0.07 | 0.013 | 0.007 | 0.046 | 0.0021 | 0.042 | 0.012 | 0.0003 | 0.0243 | 0.095 | 10.47 |
| C-20 | 0.0019 | 0.01 | 0.11 | 0.014 | 0.008 | 0.045 | 0.0017 | 0.072 | tr | 0.0003 | 0.0542 | 0.035 | 11.46 |
| C-21 | 0.0019 | 0.02 | 0.18 | 0.009 | 0.008 | 0.048 | 0.0020 | 0.076 | tr | 0.0013 | 0.0571 | 0.033 | 10.05 |
| C-22 | 0.0035 | 0.03 | 0.12 | 0.012 | 0.013 | 0.045 | 0.0023 | 0.061 | tr | 0.0005 | 0.0336 | 0.033 | 9.863 |
| C-23 | 0.0019 | 0.01 | 0.15 | 0.015 | 0.022 | 0.035 | 0.0019 | 0.071 | tr | 0.0006 | 0.0315 | 0.06 | 10.23 |
| C-24 | 0.0022 | 0.02 | 0.14 | 0.012 | 0.011 | 0.047 | 0.0023 | 0.092 | 0.011 | 0.0005 | 0.0676 | 0.033 | 11.03 |
| C-25 | 0.0018 | 0.01 | 0.11 | 0.009 | 0.009 | 0.051 | 0.0018 | 0.121 | tr | 0.0008 | 0.1013 | 0.018 | 11.16 |
| C-26 | 0.0016 | 0.01 | 0.12 | 0.011 | 0.006 | 0.058 | 0.0017 | 0.118 | tr | 0.0004 | 0.1032 | 0.016 | 11.99 |

Then, samples within the scope of the present invention (hereinafter referred to as the "samples of the invention") Nos. 1 to 13 each having a prescribed shape and prescribed dimensions, were cut out from the continuously annealed cold-rolled steel sheets of the invention Nos. 1 to 13, and samples outside the scope of the present invention (hereinafter referred to as the "samples for comparison") Nos. 14 to 39 each having a prescribed shape and prescribed dimensions, were cut out from the continuously annealed cold-rolled steel sheets for comparison Nos. 14 to 39.

For each of the above-mentioned samples of the invention Nos. 1 to 13 and the samples for comparison Nos. 14 to 39, a minimum Lankford value (rmin) and a secondary-work brittleness transition temperature (Tth)(K) were measured, and an index rmin/Tth, which represented balance between deep drawability and resistance to secondary-work embrittlement, was calculated from the thus measured values.

On the other hand, for each of the continuously cast steel slabs made of the steels I-1 to 1-13, having the chemical compositions within the scope of the present invention as shown in Table 4, and the continuously cast steel slabs made of the steels C-1 to C-13, having the chemical compositions outside the scope of the present invention as shown in Table 5, the production of pinholes on the slab surface was investigated. The method for investigating the production of pinholes on the slab surface comprised inspecting the upper surface of each slab by means of an automatic surface defect detector, calculating the number of pinholes per unit area on the basis of the analysis of the results of the inspection, and determining a defect index of slab surface defects on the basis of the thus calculated number of produced pinholes. The results of this investigation are shown in Tables 6(1) and 6(2).

In Tables 6(1) and 6(2), the density of the slab surface defects is expressed by the following symbols:

⊚: the density index of slab surface defects is zero/$m^2$;

○: the density index of slab surface defects is from over zero to 2/$m^2$;

Δ: the density index of slab surface defects is from over 2 to under 4/$m^2$; and x: the density index of slab surface defects is over 4/$m^2$.

For each of the samples of the invention Nos. 1 to 13 and the samples for comparison Nos. 14 to 39, a minimum Lankford value (rmin) and a secondary-work brittleness transition temperature (Tth)(K), were determined in the same manner as described in the paragraph concerning boron (this is also the case with the following examples).

TABLE 6 (1)

| | No. | Kind of steel | $r_{min}$ | $T_{th}$ (K) | $r_{min}/T_{th}$ (1/K) | Slab surface defects |
|---|---|---|---|---|---|---|
| Sample of the invention | 1 | I-1 | 2.08 | 123 | 0.0169 | ◎ |
| | 2 | I-2 | 2.02 | 123 | 0.0164 | ◎ |
| | 3 | I-3 | 2.01 | 123 | 0.0163 | ◎ |
| | 4 | I-4 | 2.21 | 123 | 0.0180 | ◎ |
| | 5 | I-5 | 2.09 | 123 | 0.0170 | ◎ |
| | 6 | I-6 | 2.08 | 123 | 0.0169 | ◎ |
| | 7 | I-7 | 2.14 | 133 | 0.0161 | ◎ |
| | 8 | I-8 | 2.18 | 133 | 0.0164 | ◎ |
| | 9 | I-9 | 2.21 | 133 | 0.0166 | ○ |
| | 10 | I-10 | 2.25 | 133 | 0.0169 | ○ |
| | 11 | I-11 | 2.2 | 143 | 0.0154 | ○ |
| | 12 | I-12 | 2.15 | 133 | 0.0162 | ◎ |
| | 13 | I-13 | 2.08 | 133 | 0.0156 | ◎ |

TABLE 6 (2)

| | No. | Kind of steel | $r_{min}$ | $T_{th}$ (K) | $r_{min}/T_{th}$ (1/K) | Slab surface defects |
|---|---|---|---|---|---|---|
| Sample for comparison | 14 | C-1 | 1.98 | 133 | 0.0149 | ◎ |
| | 15 | C-2 | 1.64 | 113 | 0.0145 | ◎ |
| | 16 | C-3 | 1.62 | 113 | 0.0143 | ◎ |
| | 17 | C-4 | 1.74 | 123 | 0.0141 | ◎ |
| | 18 | C-5 | 1.8 | 123 | 0.0146 | ◎ |
| | 19 | C-6 | 1.82 | 123 | 0.0148 | ◎ |
| | 20 | C-7 | 2.12 | 223 | 0.0095 | Δ |
| | 21 | C-8 | 2.02 | 223 | 0.0091 | X |
| | 22 | C-9 | 2.1 | 223 | 0.0094 | X |
| | 23 | C-10 | 2.15 | 153 | 0.0141 | ◎ |
| | 24 | C-11 | 1.75 | 123 | 0.0142 | ◎ |
| | 25 | C-12 | 1.9 | 133 | 0.0143 | ◎ |
| | 26 | C-13 | 1.63 | 113 | 0.0144 | ◎ |
| | 27 | C-14 | 1.58 | 113 | 0.0140 | ◎ |
| | 28 | C-15 | 1.83 | 123 | 0.0149 | ◎ |
| | 29 | C-16 | 2.02 | 173 | 0.0117 | Δ |
| | 30 | C-17 | 2.06 | 183 | 0.0113 | Δ |
| | 31 | C-18 | 1.65 | 123 | 0.0134 | ◎ |
| | 32 | C-19 | 1.61 | 123 | 0.0131 | ◎ |
| | 33 | C-20 | 2.26 | 173 | 0.0131 | Δ |
| | 34 | C-21 | 1.89 | 133 | 0.0142 | Δ |
| | 35 | C-22 | 1.89 | 133 | 0.0142 | ◎ |
| | 36 | C-23 | 2.02 | 153 | 0.0132 | ◎ |
| | 37 | C-24 | 1.71 | 123 | 0.0139 | Δ |
| | 38 | C-25 | 2.11 | 143 | 0.0148 | X |
| | 39 | C-26 | 2.13 | 143 | 0.0149 | X |

As is clear from Tables 6(1) and 6(2), all the samples of the invention Nos. 1–13 had a value of the index rmin/Tth of at least 0.015, and were excellent in balance between deep drawability and resistance to secondary-work embrittlement. All the samples for comparison Nos. 14 to 39 had in contrast a value of the index rmin/Tth of under 0.015, and were inferior to the samples of the invention in balance between deep drawability and resistance to secondary-work embrittlement. With regard to the production of pinholes on the slab surface, the density of produced pinholes on all the samples of the invention Nos. 1 to 13 was zero/$m^2$ or from over zero to 2/$m^2$ which was admissible in practice. In contrast, the density of produced pinholes on some of the samples for comparison Nos. 14 to 39 was from over 2 to under 4/$m^2$ or at least 4/$m^2$, which had a problem in practice.

EXAMPLE 2

Each of the continuously cast steel slabs made of the steels I-1 to I-3, I-5 to 1-11 and 1-13, having chemical compositions within the scope of the present invention as shown in Table 4, and the continuously cast steel slabs made of the steels C-7 to C-9 and C-16 to C-21, having chemical compositions outside the scope of the present invention as shown in Tables 5(1) and 5(2), was directly hot-roughing-rolled without reheating same to a thickness of 36 mm in a roughing-rolling train of a hot-rolling mill, then after adjusting a value of a reduction rate distribution in the third and second roll stands on the exit side of a finishing-rolling train of the hot-rolling mill so that a value calculated by means of the above-mentioned reduction rate distribution function Y became 0.28 in the finishing-rolling train having seven roll stands, hot-finishing-rolled at a finishing temperature within a range of from 880° to 910° C. and a coiling temperature of 660° C., to prepare a hot-rolled steel strip having a thickness of 3.2 mm. Then, the thus prepared hot-rolled steel strip was pickled, and then cold-rolled to prepare a cold-rolled steel strip having a thickness of 0.8 mm. Then, the thus prepared cold-rolled steel strip was continuously annealed at a temperature within a range of from 840° to 850° C., and then temper-rolled at a reduction rate of 0.5%, thereby obtaining continuously annealed cold-rolled steel sheets within the scope of the present invention (hereinafter referred to as the "continuously annealed cold-rolled steel sheets of the invention") Nos. 40 to 50, prepared under the manufacturing conditions within the scope of the present invention from the steel slabs having the chemical compositions within the scope of the present invention, and continuously annealed cold-rolled steel sheets outside the scope of the present invention (hereinafter referred to as the "continuously annealed cold-rolled steel sheets for comparison") Nos. 51 to 59, prepared under the manufacturing conditions within the scope of the present invention from the steel slabs having the chemical compositions outside the scope of the present invention.

Then, samples within the scope of the present invention (hereinafter referred to as the "samples of the invention") Nos. 40 to 50 each having a prescribed shape and prescribed dimensions, were cut out from the continuously annealed cold-rolled steel sheets of the invention Nos. 40 to 50, and samples outside the scope of the present invention (hereinafter referred to as the "samples for comparison") Nos. 51 to 59 each having a prescribed shape and prescribed dimensions, were cut out from the continuously annealed cold-rolled steel sheets for comparison Nos. 51 to 59.

For each of the above-mentioned samples of the invention Nos. 40 to 50 and the samples for comparison Nos. 51 to 59, a minimum Lankford value (rmin) and a secondary-work brittleness transition temperature (Tth)(K) were measured, and an index (rmin/Tth), which represented balance between deep drawability and resistance to secondary-work embrittlement, was calculated from the thus measured values.

On the other hand, for each of the continuously cast steel slabs made of the steels I-1 to I-3, I-5 to I-11 and I-13, having the chemical compositions within the scope of the present invention as shown in Table 4, and the continuously cast steel slabs made of the steels C-7 to C-9 and C-16 to C-21, having the chemical compositions outside the scope of the present invention as shown in Tables 5(1) and 5(2), the production of pinholes on the slab surface was investigated. The results of these investigation are shown in Table 7.

The investigation of pinholes on the slab surface and the evaluation of the results of the investigation were carried out in the same manner as in Example 1.

TABLE 7

| | No. | Kind of steel | Density index of slab surface defects | $r_{min}$ | $T_{th}$ (K) | $r_{min}/T_{th}$ (1/K) |
|---|---|---|---|---|---|---|
| Sample of the invention | 40 | I-1 | 0 | 2.05 | 123 | 0.01667 |
| | 41 | I-2 | 0 | 1.98 | 113 | 0.01752 |
| | 42 | I-3 | 0 | 1.97 | 123 | 0.01602 |
| | 43 | I-5 | 0 | 2.03 | 113 | 0.01796 |
| | 44 | I-6 | 0 | 2.04 | 123 | 0.01659 |
| | 45 | I-7 | 0 | 2.02 | 123 | 0.01642 |
| | 46 | I-8 | 0 | 2.04 | 123 | 0.01659 |
| | 47 | I-9 | 0 | 2.11 | 123 | 0.01715 |
| | 48 | I-10 | 0.2 | 2.18 | 123 | 0.01772 |
| | 49 | I-11 | 0.3 | 2.12 | 133 | 0.0159 |
| | 50 | I-13 | 0.4 | 2.05 | 123 | 0.01667 |
| Sample for comparison | 51 | C-7 | 1.8 | 2.04 | 203 | 0.01005 |
| | 52 | C-8 | 0.5 | 1.96 | 203 | 0.00966 |
| | 53 | C-9 | 2.4 | 1.91 | 223 | 0.00857 |
| | 54 | C-16 | 1.2 | 1.97 | 173 | 0.01139 |
| | 55 | C-17 | 1.1 | 1.98 | 173 | 0.01145 |
| | 56 | C-18 | 0 | 1.55 | 123 | 0.0126 |
| | 57 | C-19 | 0 | 1.54 | 123 | 0.01252 |
| | 58 | C-20 | 0.7 | 2.07 | 163 | 0.01270 |
| | 59 | C-21 | 0.9 | 1.71 | 123 | 0.01390 |

As is clear from Table 7, all the samples of the invention Nos. 40 to 50 had a value of the index rmin/Tth of at least 0.015, and were excellent in balance between deep drawability and resistance to secondary-work embrittlement. All the samples for comparison Nos. 51 to 59 had in contrast a value of the index rmin/Tth of under 0.015, and were inferior to the samples of the invention in balance between deep drawability and resistance to secondary-work embrittlement. With regard to the production of pinholes on the slab surface, although a very small number of pinholes were produced in a few cases among the samples of the invention Nos. 40–50, most of the samples of the invention were free from pinholes. In most of the samples for comparison Nos. 51 to 59, in contrast, pinholes were produced.

EXAMPLE 3

Each of the continuously cast steel slabs made of the steels I-3 to I-5, I-7, I-10 and I-13, having chemical compositions within the scope of the present invention as shown in Table 4, and the continuously cast steel slab made of the steel C-10 having the chemical composition outside the scope of the present invention as shown in Tables 5(1) and 5(2), was heated to a temperature of 1,200° C., hot-roughing-rolled to a thickness of 36 mm or 44 mm in a roughing-rolling train of a hot-rolling mill under the conditions as shown in Tables 8, 9(1) and 9(2), then after adjusting a value of a reduction rate distribution in a plurality of roll stands in a finishing-rolling train having seven roll stands of the hot-rolling mill so that a value calculated by the above-mentioned reduction rate distribution function Y under the conditions as shown in Tables 8, 9(1) and 9(2) became within a range of from 0.21 to 0.36, and then, hot-finishing-rolled at a finishing temperature within a range of from 860° to 940° C. and a coiling temperature within a range of from 600° to 680° C., to prepare a hot-rolled steel strip having a thickness of 2.8 mm or 3.2 mm. Then, the thus prepared hot-rolled steel strip was pickled, and then cold-rolled to prepare a cold-rolled steel strip having a thickness of 0.8 mm. Then, the thus prepared cold-rolled steel strip was continuously annealed at a temperature within a range of from 820° to 850° C., and then temper-rolled at a reduction rate of 0.5%, thereby obtaining continuously annealed cold-rolled steel sheets within the scope of the present invention (hereinafter referred to as the "continuously annealed cold-rolled steel sheets of the invention") Nos. 60 to 68, prepared under the manufacturing conditions within the scope of the present invention from the steel slabs having the chemical compositions within the scope of the present invention, and continuously annealed cold-rolled steel sheets outside the scope of the present invention (hereinafter referred to as the "continuously annealed cold-rolled steel sheets for comparison") Nos. 69 to 87, for which at least one of the chemical composition and the manufacturing conditions was outside the scope of the present invention.

Then, samples within the scope of the present invention (hereinafter referred to as the "samples of the invention") Nos. 60 to 68 each having a prescribed shape and prescribed dimensions, were cut out from the continuously annealed cold-rolled steel sheets Nos. 60 to 68, and samples outside the scope of the present invention (hereinafter referred to as the "samples for comparison") Nos. 69 to 87 each having a prescribed shape and prescribed dimensions, were cut out from the continuously annealed cold-rolled steel sheets for comparison Nos. 69 to 87.

For each of the above-mentioned samples of the invention Nos. 60 to 68 and samples for comparison Nos. 69 to 87, an index (rmin/Tth), which represented balance between deep drawability and resistance to secondary-work embrittlement, was calculated. The results are shown in Tables 8, 9(1) and 9(2).

TABLE 8

| | | | Sheet thickness | | Hot-finishing-rolling condition | | |
|---|---|---|---|---|---|---|---|
| | No. | Kind of steel | before hot-finish.-rolling (mm) | after hot-finish.-rolling (mm) | reduction rate distribution function (Y) | temperature (°C.) | $r_{min}/T_{th}$ (1/K) |
| Sample of the invention | 60 | I-3 | 36 | 3.2 | 0.27 | 910 | 0.0165 |
| | 61 | I-3 | 36 | 3.2 | 0.27 | 880 | 0.0173 |
| | 62 | I-4 | 40 | 2.8 | 0.26 | 910 | 0.0158 |
| | 63 | I-4 | 40 | 2.8 | 0.28 | 920 | 0.0172 |
| | 64 | I-4 | 40 | 2.8 | 0.28 | 890 | 0.0181 |
| | 65 | I-5 | 40 | 2.8 | 0.28 | 900 | 0.0163 |
| | 66 | I-7 | 36 | 2.8 | 0.28 | 910 | 0.0171 |
| | 67 | I-13 | 36 | 3.2 | 0.27 | 900 | 0.0157 |
| | 68 | I-13 | 36 | 3.2 | 0.30 | 900 | 0.0159 |

TABLE 9 (1)

| | No. | Kind of steel | Sheet thickness: before hot-finish.-rolling (mm) | Sheet thickness: after hot-finish.-rolling (mm) | Hot-finishing-rolling condition: reduction rate distribution function (Y) | Hot-finishing-rolling condition: temperature (°C.) | $r_{min}/T_{th}$ (1/K) |
|---|---|---|---|---|---|---|---|
| Sample for comparison | 69 | I-3 | 36 | 3.2 | *0.21 | 910 | 0.0146 |
| | 70 | I-3 | 36 | 3.2 | 0.27 | *860 | 0.0141 |
| | 71 | I-3 | 36 | 3.2 | *0.32 | 880 | 0.0146 |
| | 72 | I-3 | 36 | 3.2 | *0.32 | *860 | 0.0135 |
| | 73 | I-4 | 40 | 2.8 | *0.21 | 900 | 0.0139 |
| | 74 | I-4 | 40 | 2.8 | *0.24 | 910 | 0.0143 |
| | 75 | I-4 | 40 | 2.8 | 0.26 | *930 | 0.0146 |
| | 76 | I-4 | 40 | 2.8 | 0.26 | *870 | 0.0141 |
| | 77 | I-4 | 40 | 2.8 | *0.32 | 900 | 0.0147 |
| | 78 | I-5 | 40 | 2.8 | *0.21 | 900 | 0.0139 |

*outside the scope of the invention

TABLE 9 (2)

| | No. | Kind of steel | Sheet thickness: before hot-finish.-rolling (mm) | Sheet thickness: after hot-finish.-rolling (mm) | Hot-finishing-rolling condition: reduction rate distribution function (Y) | Hot-finishing-rolling condition: temperature (°C.) | $r_{min}/T_{th}$ (1/K) |
|---|---|---|---|---|---|---|---|
| Sample for comparison | 79 | I-5 | 40 | 2.8 | 0.28 | *940 | 0.0141 |
| | 80 | I-5 | 40 | 2.8 | *0.34 | 900 | 0.0136 |
| | 81 | I-7 | 36 | 2.8 | *0.21 | 910 | 0.0148 |
| | 82 | I-7 | 36 | 2.8 | *0.34 | 910 | 0.0138 |
| | 83 | I-10 | 36 | 3.2 | *0.22 | 900 | 0.0141 |
| | 84 | I-10 | 36 | 3.2 | *0.24 | 900 | 0.0147 |
| | 85 | I-10 | 36 | 3.2 | *0.36 | 900 | 0.0138 |
| | 86 | *C-10 | 40 | 2.8 | 0.28 | 910 | 0.0141 |
| | 87 | *C-10 | 40 | 2.8 | 0.28 | 890 | 0.0139 |

*outside the scope of the invention

As is clear from Tables 8, 9(1) and 9(2), all the samples of the invention Nos. 60 to 68 had a value of the index rmin/Tth of at least 0.015, and were excellent in balance between deep drawability and resistance to secondary-work embrittlement. All the samples for comparison Nos. 69 to 87 had in contrast a value of the index rmin/Tth of under 0.015, and were inferior to the samples of the invention in balance between deep drawability and resistance to secondary-work embrittlement.

According to the present invention, as described above in detail, there are available a continuously annealed cold-rolled steel sheet excellent in balance between deep drawability and resistance to secondary-work embrittlement and a method for manufacturing same, thereby providing many industrially useful effects.

What is claimed is:

1. A continuously annealed cold-rolled steel sheet excellent in balance between deep drawability and resistance to secondary-work embrittlement, which consists essentially of:

carbon (C): under 0.0030 wt. %, silicon (Si): up to 0.05 wt. %, manganese (Mn): from 0.05 to 0.20 wt. %, phosphorus (P): up to 0.02 wt. %, sulfur (S): up to 0.015 wt. %, acid-soluble aluminum (sol.Al): from 0.02 to 0.06 wt. %, nitrogen (N): up to 0.0030 wt. %, titanium (Ti): from 0.02 to 0.10 wt. %, boron (B): from 0.0003 to 0.0010 wt. %, and the balance being iron (Fe) and incidental impurities, where, a value of an index (X) representing a content rate of titanium to boron, as calculated by the following formulae (1) and (2), is within a range of from 9.2 to 11.2:

$$X=-\ln\{(C/Ti^*)B\} \quad (1)$$

in said formula (1):

$$Ti^*=Ti-(48/14)N-(48/32)S>0 \quad (2).$$

2. A continuously annealed cold-rolled steel sheet as claimed in claim 1, wherein:

a content of said sulfur is up to 0.010 wt. %, and a content of said titanium is within a range of from 0.02 to under 0.07 wt. %.

3. A continuously annealed cold-rolled steel sheet as claimed in claim 1, wherein:

said continuously annealed cold-rolled steel sheet is manufactured by a method including a step of hot-rolling a steel slab to prepare a hot-rolled steel strip; and a finishing-rolling in said hot-rolling is carried out at a finishing temperature within a range of from 880° to 920° C. so that a reduction rate distribution function (Y) expressed by the following formula (3) satisfies the following formula (4):

$$Y=\{\ln(t_{n-3}/t_{n-2})+\ln(t_{n-2}/t_{n-1})\}/\ln(t_0/t_n) \quad (3)$$

where, n: number of roll stands of a finishing-rolling train in a hot-rolling mill, $t_0$: thickness of a steel sheet on the entry side of the first roll stand of said finishing-rolling train, $t_{n-3}$: thickness of the steel sheet on the exit side of the n-3-th roll stand of said finishing-rolling train, $t_{n-2}$: thickness of the steel sheet on the exit side of the n-2-th roll stand of said finishing-rolling train, $t_{n-1}$: thickness of the steel sheet on the exit side of the n-1-th roll stand of said finishing-rolling train, and $t_n$: thickness of the steel sheet on the exit side of the n-th roll stand of said finishing-rolling train, and $$0.015X+0.09 \leqq Y \leqq 0.01X+0.21 \quad (4)$$

where,

X: said index calculated by said formulae (1) and (2).

4. A method for manufacturing a continuously annealed cold-rolled steel sheet excellent in balance between deep drawability and resistance to secondary-work embrittlement, which comprises the steps of:

preparing a steel slab consisting essentially of:

carbon (C): under 0.0030 wt. %, silicon (Si): up to 0.05 wt. %, manganese (Mn): from 0.05 to 0.20 wt. %, phosphorus (P): up to 0.02 wt. %, sulfur (S): up to 0.015 wt. %, acid-soluble aluminum (sol.Al): from 0.025 to 0.06 wt. %, nitrogen (N): up to 0.0030 wt. %, titanium (Ti): from 0.02 to 0.10 wt. %, boron (B): from 0.0003 to 0.0010 wt. %, and the balance being iron (Fe) and incidental impurities, where, a value of index ( X ) representing a content ratio of titanium to boron, as calculated by the following formulae (1) and (2), is within a range of from 9.2 to 11.2:

$$X=-\ln\{(C/Ti^*)B\} \quad (1)$$

in said formula (1):

$$Ti^*=Ti-(48/14)N-(48/32)S>0 \quad (2);$$

then hot-rolling said steel slab to prepare a hot-rolled steel strip;

carrying out a finishing-rolling in said hot-rolling so that a reduction rate distribution function (Y) expressed by the following formula (3) satisfies the following formula (4):

$$Y=\{ln(t_{n-3}/t_{n-2})+ln(t_{n-2}/t_{n-1})\}/ln(t_0/t_n) \quad (3)$$

where, n: number of roll stands of a finishing-rolling train in a hot-rolling mill, $t_0$: thickness of a steel sheet on the entry side of the first roll stand of said finishing-rolling train, $t_{n-3}$: thickness of the steel sheet on the exit side of the n-3-th roll stand of said finishing-rolling train, $t_{n-2}$: thickness of the steel sheet on the exit side of the n-2-th roll stand of said finishing-rolling train, $t_{n-1}$: thickness of the steel sheet on the exit side of the n-1-th roll stand of said finishing-rolling train, and $t_n$: thickness of the steel sheet on the exit side of the n-th roll stand of said finishing-rolling train, and $$0.015X+0.09 \leqq Y \leqq 0.01X+0.21 \quad (4)$$

where,

X: said index calculated by said formulae (1) and (2); then completing said finishing-rolling at a temperature within a range of from 880° to 920° C.; then coiling the resultant hot-rolled steel strip; then subjecting said hot-rolled steel strip to a cold-rolling at an accumulative reduction rate of at least 70% to prepare a cold-rolled steel strip; and then subjecting said cold-rolled steel strip to a continuous annealing in a temperature region of from 750° C. to an $Ac_3$ transformation point.

5. A method for manufacturing a continuously annealed cold-rolled steel sheet as claimed in claim 4, wherein:

a content of said sulfur is up to 0.010 wt. %, and a content of said titanium is within a range of from 0.02 to under 0.07 wt. %.

6. A continuously annealed cold-rolled steel sheet claimed in claim 2, wherein:

said continuously annealed cold-rolled steel sheet is manufactured by a method including a step of hot-rolling a steel slab to prepare a hot-rolled steel strip; and a finishing-rolling in said hot-rolling is carried out at a finishing temperature within a range of from 880° to 920° C. so that a reduction rate distribution function (Y) expressed by the following formula (3) satisfies the following formula (4):

$$Y=\{ln(t_{n-3}/t_{n-2})+ln(t_{n-2}/t_{n-1})\}/ln(t_0/t_n) \quad (3)$$

where, n: number of roll stands of a finishing-rolling train in a hot-rolling mill, $t_0$: thickness of a steel sheet on the entry side of the first roll stand of said finishing-rolling train, $t_{n-3}$: thickness of the steel sheet on the exit side of the n-3-th roll stand of said finishing-rolling train, $t_{n-2}$: thickness of the steel sheet on the exit side of the n-2-th roll stand of said finishing-rolling train, $t_{n-2}$: thickness of the steel sheet on the exit side of the n-1-th roll stand of said finishing-rolling train, and $t_n$: thickness of the steel sheet on the exit side of the n-th roll stand of said finishing-rolling train, and $$0.015X+0.09 \leqq Y \leqq 0.01X+0.21 \quad (4)$$

where,

X: said index calculated by said formulae (1) and (2).

* * * * *

UNITED STATES PATENT AND TRADEMARK OFFICE

CERTIFICATE OF CORRECTION

PATENT NO. : 5,531,839

DATED : July 2, 1996

INVENTOR(S) : HOSOYA et al

It is certified that error appears in the above-indentified patent and that said Letters Patent is hereby corrected as shown below:

Title Page, [54], in the title: delete "CONTINOUSLY" and insert --CONTINUOUSLY--.

Column 27, line 65 (Claim 1): delete "0.02" and insert --0.025--.

Column 30, line 29 (Claim 6): after "sheet" insert --as--.

Column 30, line 53 (Claim 6): delete "$t_{n-2}$" and insert --$t_{n-1}$--.

Signed and Sealed this

Twenty-fourth Day of December, 1996

Bruce Lehman

*Attest:*

BRUCE LEHMAN

*Attesting Officer*

*Commissioner of Patents and Trademarks*